US011788256B2

(12) United States Patent
Vanderlaan et al.

(10) Patent No.: US 11,788,256 B2
(45) Date of Patent: Oct. 17, 2023

(54) DUAL ARCHITECTURE FOR AN ELECTRO-HYDRAULIC DRIVE SYSTEM

(71) Applicant: Parker-Hannifin Corporation, Cleveland, OH (US)

(72) Inventors: Dale Vanderlaan, Beachwood, OH (US); Blake Carl, Lyndhurst, OH (US); Hao Zhang, Twinsburg, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 36 days.

(21) Appl. No.: 17/628,262

(22) PCT Filed: Jun. 9, 2020

(86) PCT No.: PCT/US2020/036780
§ 371 (c)(1),
(2) Date: Jan. 19, 2022

(87) PCT Pub. No.: WO2021/066892
PCT Pub. Date: Apr. 8, 2021

(65) Prior Publication Data

US 2022/0282458 A1 Sep. 8, 2022

Related U.S. Application Data

(60) Provisional application No. 62/908,922, filed on Oct. 1, 2019.

(51) Int. Cl.
*E02F 9/22* (2006.01)
*F15B 11/17* (2006.01)
(Continued)

(52) U.S. Cl.
CPC ..... *E02F 9/2292* (2013.01); *E02F 9/2242* (2013.01); *E02F 9/2289* (2013.01);
(Continued)

(58) Field of Classification Search
CPC ..... E02F 9/2221; E02F 9/2217; E02F 9/2292; E02F 9/2289
See application file for complete search history.

(56) References Cited

U.S. PATENT DOCUMENTS 9,217,447 B2 12/2015 Dybing
9,458,864 B2 10/2016 Hyon et al.
(Continued)

FOREIGN PATENT DOCUMENTS

CN 1735750 A 2/2006
CN 103649562 A 3/2014
(Continued)

OTHER PUBLICATIONS

International Search Report and Written Opinion prepared by the European Patent Office in International Application No. PCT/US2020/036780 dated Oct. 23, 2020.
(Continued)

*Primary Examiner* — Abiy Teka
(74) *Attorney, Agent, or Firm* — McDonnell Boehnen Hulbert & Berghoff LLP

(57) ABSTRACT

An example hydraulic system includes a hydraulic actuator; a pump driven by an electric motor and having an inlet port and an outlet port; a boost flow line configured to provide boost fluid flow or receive excess fluid flow; a reservoir fluid line fluidly coupled to a reservoir; and a valve assembly configured to operate in a plurality of states to allow the pump to operate in a closed-circuit configuration in which fluid discharged from the hydraulic actuator is provided to the inlet port of the pump or an open-circuit configuration in which fluid discharged from the hydraulic actuator is provided to the reservoir.

20 Claims, 9 Drawing Sheets

(51) Int. Cl.
*F15B 13/08* (2006.01)
*F15B 15/18* (2006.01)

(52) U.S. Cl.
CPC ..... *F15B 11/17* (2013.01); *F15B 13/0885* (2013.01); *F15B 15/18* (2013.01); *F15B 2211/20515* (2013.01); *F15B 2211/20576* (2013.01)

(56) References Cited

U.S. PATENT DOCUMENTS

| | | | | |
|---|---|---|---|---|
| 9,903,094 | B2 | 2/2018 | Takahashi | |
| 10,119,556 | B2 | 11/2018 | Peterson et al. | |
| 2011/0030364 | A1 | 2/2011 | Persson et al. | |
| 2011/0209471 | A1 | 9/2011 | Vanderlaan et al. | |
| 2013/0098019 | A1* | 4/2013 | Opdenbosch | F15B 7/008 60/428 |
| 2015/0308463 | A1* | 10/2015 | Gomm | F15B 11/003 60/459 |
| 2018/0245312 | A1* | 8/2018 | Sugano | E02F 9/2289 |
| 2019/0145433 | A1* | 5/2019 | Thompson | F15B 11/17 60/422 |

FOREIGN PATENT DOCUMENTS

| | | | |
|---|---|---|---|
| CN | 203743137 | U | 7/2014 |
| CN | 105339682 | A | 2/2016 |
| CN | 105531485 | A | 4/2016 |
| CN | 105889736 | A | 8/2016 |
| JP | H07-2606 | U | 1/1995 |
| JP | 2016145603 | A | 8/2016 |
| WO | 2009/102740 | A2 | 8/2009 |
| WO | 2017/192303 | A1 | 11/2017 |
| WO | 2010/028100 | A1 | 3/2020 |

OTHER PUBLICATIONS

First Office Action issued by the China National Intellectual Property Administration in application No. 202080060488.0 dated Dec. 13, 2022. English Translation included.

Notice of the Reason for Refusal issued by the Japanese Patent Office in application No. 2022-512796 dated Feb. 14, 2023. English Translation included.

Notice of Granting Patent Right For Invention and Supplementary Search Report issued by the Chinese Patent Office in application No. 202080060488.0 dated Apr. 15, 2023. English Translation included.

* cited by examiner

DUAL ARCHITECTURE FOR AN ELECTRO-HYDRAULIC DRIVE SYSTEM

CROSS REFERENCE TO RELATED APPLICATION

The present application claims priority to U.S. Provisional Application No. 62/908,922, filed on Oct. 1, 2019, which is hereby incorporated by reference in its entirety.

TECHNICAL FIELD

The disclosure relates generally to hydraulic actuation systems for operating actuators of a work machine (e.g., an excavator, a wheel loader, a backhoe, etc.). Particularly, the disclosure relates to using electric motor-driven hydrostatic pumps for respective actuators of the machine and a dual system architecture that allows for switching between a closed-circuit operation and an open-circuit operation of the respective pumps.

BACKGROUND

It is common for a work machine, such as but not limited to hydraulic excavators, wheel loaders, loading shovels, backhoe shovels, mining equipment, industrial machinery and the like, to have one or more actuated components such as lifting and/or tilting arms, booms, buckets, steering and turning functions, traveling means, etc. Commonly, in such machines, a prime mover drives a hydraulic pump for providing fluid to the actuators. Open-center or closed center valves can control the flow of fluid to the actuators. Such valves are characterized by large power losses due to throttling flow therethrough. Further, such conventional systems may involve providing a constant amount of flow from a pump regardless of how many of the actuators is being used. Thus, such systems are characterized by poor efficiencies.

It may thus be desirable to have a hydraulic system that enhances efficiency of a work machine. It is with respect to these and other considerations that the disclosure made herein is presented.

SUMMARY

The present disclosure describes implementations that relate to a dual architecture for an electro-hydraulic drive system.

In a first example implementation, the present disclosure describes a hydraulic system. The hydraulic system comprises: (i) a hydraulic actuator configured to receive and discharge fluid flow to move a piston or a hydraulic motor; (ii) a pump configured to be a fluid flow source driven by an electric motor to provide fluid flow to the hydraulic actuator, wherein the pump has an inlet port and an outlet port; (iii) a boost flow line configured to provide boost fluid flow or receive excess fluid flow; (iv) a reservoir fluid line fluidly coupled to a reservoir; and (v) a valve assembly configured to operate in a plurality of states comprising at least: (a) a first state in which the valve assembly blocks flow path between the inlet port of the pump and the reservoir, thereby allowing the pump to operate in a closed-circuit configuration in which fluid discharged from the hydraulic actuator is provided to the inlet port of the pump, and (b) a second state in which the valve assembly opens flow path between the inlet port of the pump and the reservoir to allow the pump to draw fluid from the reservoir, and opens flow path from the outlet port of the pump to the boost flow line, thereby allowing the pump to operate in an open-circuit configuration in which fluid discharged from the hydraulic actuator is provided to the reservoir.

In a second example implementation, the present disclosure describes a machine. The machine includes: (i) a boost flow line configured to provide boost fluid flow or receive excess fluid flow; a reservoir fluid line fluidly coupled to a reservoir; and a plurality of hydraulic actuators, wherein each hydraulic actuator of the plurality of hydraulic actuators is configured to receive and discharge fluid flow to move a piston or a hydraulic motor, and wherein each hydraulic actuator comprises: (a) a pump configured to be a fluid flow source driven by an electric motor to provide fluid flow to a respective hydraulic actuator to drive the respective hydraulic actuator, wherein the pump has an inlet port and an outlet port, and (b) a valve assembly configured to operate in a plurality of states. In a first state of the plurality of states, the valve assembly blocks flow path between the inlet port of the pump and the reservoir, thereby allowing the pump to operate in a closed-circuit configuration in which fluid discharged from the respective hydraulic actuator is provided to the inlet port of the pump. In a second state of the plurality of state, the valve assembly opens flow path between the inlet port of the pump and the reservoir to allow the pump to draw fluid from the reservoir, and opens flow path from the outlet port of the pump to the boost flow line, thereby allowing the pump to operate in an open-circuit configuration in which fluid discharged from the respective hydraulic actuator is provided to the reservoir.

In a third example implementation, the present disclosure describes a method. The method comprises receiving, at a controller of a hydraulic system, a request to actuate a first hydraulic actuator, wherein the hydraulic system comprises: (a) a first pump configured to be driven by a first electric motor to provide fluid flow to the first hydraulic actuator, wherein the first pump has a first inlet port and a first outlet port, (b) a first valve assembly configured to fluidly couple the first pump to a boost flow line and a reservoir fluid line fluidly coupled to a reservoir, (c) a second pump configured to be driven by a second electric motor to provide fluid flow to a second hydraulic actuator, wherein the second pump has a second inlet port and a second outlet port, and (d) a second valve assembly configured to fluidly couple the second pump to the boost flow line and the reservoir fluid line. The method also comprises, responsively, (a) sending a first command signal to the first electric motor to drive the first pump to provide fluid flow to drive the first hydraulic actuator, (b) operating the first valve assembly in a first state. In the first state, the first valve assembly blocks flow path between the first inlet port of the first pump and the reservoir, thereby allowing the first pump to operate in a closed-circuit configuration in which fluid discharged from the first hydraulic actuator is provided to the first inlet port of the first pump. Also, in the first state, the first valve assembly opens flow path from the boost flow line to the first inlet port of the first pump. The method further comprises sending a second command signal to the second electric motor to drive the second pump. The method also comprises: operating the second valve assembly in a second state in which the second valve assembly opens flow path between the second inlet port of the second pump and the reservoir, and opens flow path from the second outlet port of the second pump to the boost flow line, thereby allowing the second pump to operate in an open-circuit configuration in which the second pump draws fluid from the reservoir to the second inlet port of the second pump.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

An example hydraulic machine such as an excavator can use multiple hydraulic actuators to accomplish a variety of tasks. Many electric hybrid and battery powered machines use multiple hydraulic cylinders and motors to accomplish a variety of tasks. Enhancing efficiency of the machine is desirable, enabling a reduction in hybrid internal combustion engine and/or battery size while reducing the cost of thermal management of the battery.

As described below, an example system approach that enhances efficiency comprises an on-demand, closed-circuit system with a dedicated hydrostatic pump and electric motor for each actuator of the machine. This approach can enhance efficiency by eliminating valve metering characterizing conventional systems, pressure overproduction, and standby losses, while enabling hydraulic to electric energy recovery. However, having a dedicated closed-circuit for each machine actuator without enabling flow sharing between the actuators can render the system having excess flow capacity and oversized components. Further, a dedicated boost or charge circuit may be used for unbalanced cylinders, which requires rod volume compensation as described below, rendering the system costly.

Within examples disclosed herein are systems and methods that enable reducing the cost of the closed-circuit, power on-demand systems, while reducing impact on efficiency. The disclosed systems address excess flow capacity by having an architecture that enables dynamically switching between closed and open-circuit modes of operation depending on actuator duty cycles. The disclosed systems also enable the pumps that drive the actuators of the machine to provide boost flow to other actuators when demanded, thereby eliminating the need for a separate, high capacity boost pump.

Figure 1:
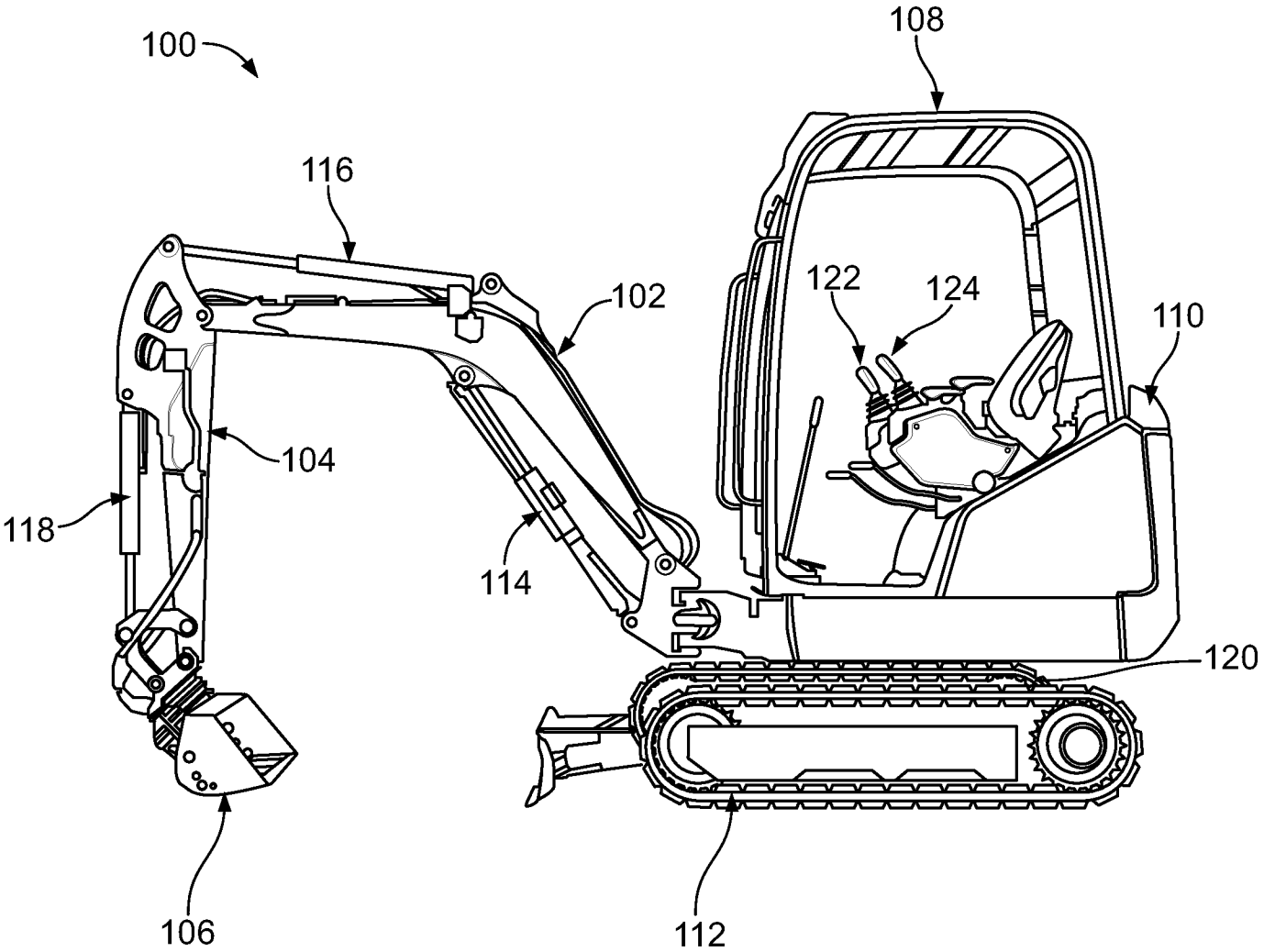
FIG. 1 illustrates an excavator, in accordance with an example implementation.

FIG. 1 illustrates an excavator 100, in accordance with an example implementation. The excavator 100 can include a boom 102, an arm 104, bucket 106, and cab 108 mounted to a rotating platform 110. The rotating platform 110 can sit atop an undercarriage with wheels or tracks such as track 112. The arm 104 can also be referred to as a dipper or stick.

Movement of the boom 102, the arm 104, the bucket 106, and the rotating platform 110 can be achieved through the use of hydraulic fluid, with hydraulic cylinders and hydraulic motors. Particularly, the boom 102 can be moved with a boom hydraulic cylinder actuator 114, the arm 104 can be moved with an arm hydraulic cylinder actuator 116, and the bucket 106 can be moved with a bucket hydraulic cylinder actuator 118.

The rotating platform 110 can be rotated by a swing drive. The swing drive can include a slew ring or a swing gear to which the rotating platform 110 is mounted. The swing drive can also include a swing hydraulic motor actuator 120 (see also rotary hydraulic motor actuator 506 in FIGS. 5-9) disposed under the rotating platform 110 and coupled to a gear box. The gear box can be configured to have a pinion that is engaged with teeth of the swing gear. As such, actuating the swing hydraulic motor actuator 120 with pressurized fluid causes the swing hydraulic motor actuator 120 to rotate the pinion of the gear box, thereby rotating the rotating platform 110.

The cab 108 can include control tools for the operator of the excavator 100. For instance, the excavator 100 can include a drive-by-wire system have a right joystick 122 and a left joystick 124 that can be used by the operator to provide electric signals to a controller of the excavator 100. The controller then provides electric command signals to various electrically-actuated components of the excavator 100 to drive the various actuators mentioned above and operate the excavator 100. As an example, the left joystick 124 can operate the arm hydraulic cylinder actuator 116 and the swing hydraulic motor actuator 120, whereas the right joystick 122 can operate the boom hydraulic cylinder actuator 114 and the bucket hydraulic cylinder actuator 118.

The excavator 100 is used herein an example machine to illustrate operation of the disclosed systems. However, it should be understood that other machines (wheel loaders, backhoes, telehandlers, etc.) can be controlled by the systems and method disclosed herein.

In a conventional machine, an engine drives one or more pumps that then provide pressurized fluid to chambers within the actuators of the machine. Pressurized fluid force acting on the actuator (e.g., piston) surface causes movement of actuators and connected work tools. Once the hydraulic energy is utilized, fluid is drained from the chambers to return to a low pressure reservoir.

Conventional hydraulic systems can include valves that throttle fluid being provided to the actuator and fluid returning from the actuator to the reservoir. Throttling fluid through the valve causes energy losses that reduce the efficiency of the hydraulic system over a course of a machine duty cycle. Another undesirable effect of fluid throttling is heating of the hydraulic fluid which results in increased cooling requirement and cost. Further, in some conventional systems involving open-center valves, one or more pumps provide a large amount of fluid flow that is sufficient to move all the actuators regardless of how many actuators are used by the operator of the machine at a particular point in the duty cycle. Excess fluid, not consumed by the actuators, is "dumped" to the reservoir.

As an example, efficiency of such a hydraulic system can be as low as 20%. To enable the hydraulic machine to use less fuel per duty cycle, it may be desirable to enhance efficiency of the hydraulic machine. Having a more efficient hydraulic machine may also enable using an electric system having a rechargeable battery, rather than a traditional internal combustion engine-driven hydraulic machine. To enhance efficiency of a hydraulic machine, conventional hydraulic system described above can be replaced with an on-demand, closed-circuit electro-hydrostatic actuator system having a dedicated hydrostatic pump and a bi-directional, variable speed electric motor for each machine actuator.

Figure 2:
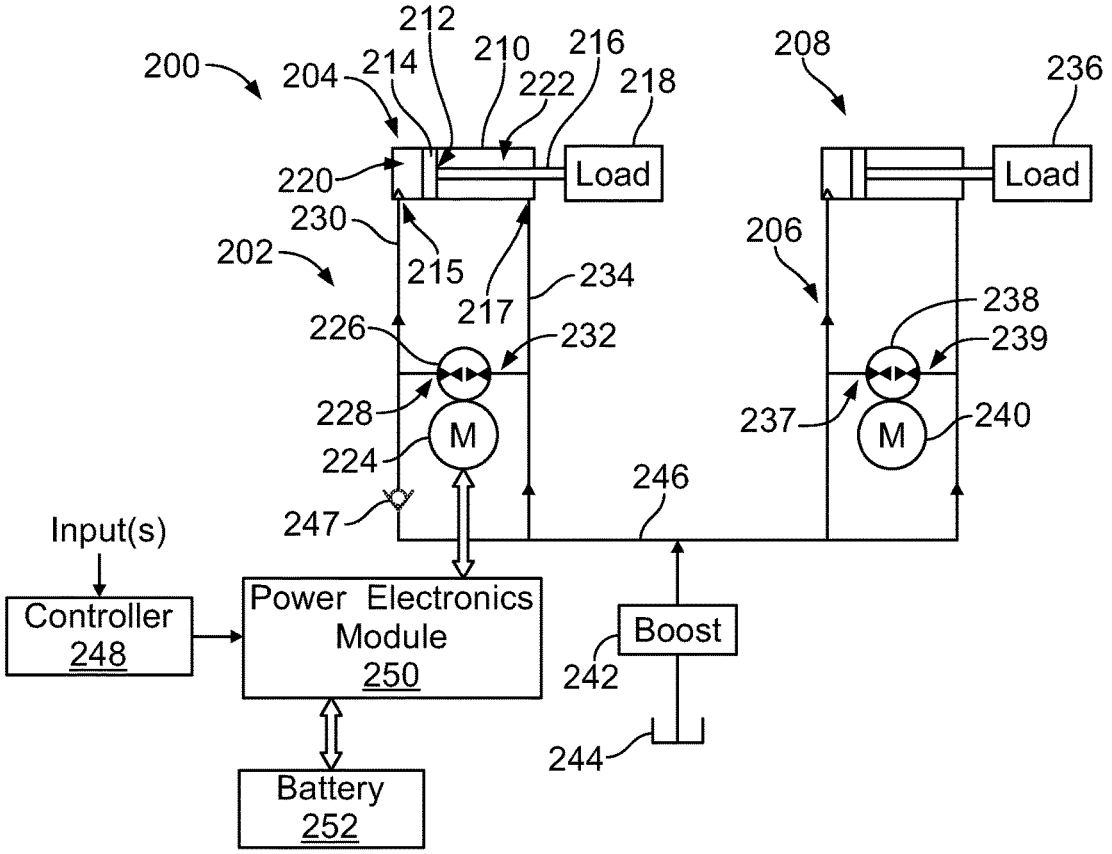
FIG. 2 illustrates a hydraulic system, in accordance with an example implementation.

FIG. 2 illustrates a hydraulic system 200, in accordance with an example implementation. The hydraulic system 200 includes an electro-hydrostatic actuator system (EHA) 202 controlling a first hydraulic cylinder actuator 204 and an EHA 206 controlling a second hydraulic cylinder actuator 208. The hydraulic cylinder actuators 204, 208 can, for example, represent any of the cylinder actuators of the excavator 100. However, it should be understood that the hydraulic system 200 can include any number of actuators and other types of actuators (e.g., hydraulic motors).

The hydraulic cylinder actuator 204 includes a cylinder 210 and a piston 212 slidably accommodated in the cylinder 210 and configured to move in a linear direction therein. The piston 212 includes a piston head 214 and a rod 216 extending from the piston head 214 along a central longitudinal axis direction of the cylinder 210. The rod 216 is coupled to a load 218 (that represents, for example, the boom 102, the arm 104, or the bucket 106 and any forces applied thereto). The piston head 214 divides the internal space of the cylinder 210 into a first chamber 220 and a second chamber 222.

The first chamber 220 can be referred to as head-side chamber as the fluid therein interacts with the piston head 214, and the second chamber 222 can be referred to as rod-side chamber as the rod 216 is disposed partially therein. Fluid can flow to and from the first chamber 220 through a workport 215, and can flow to and from the second chamber 222 through a workport 217.

The piston head 214 can have a diameter DH, whereas the rod 216 can have a diameter $D_R$. As such, fluid in the first chamber 220 interacts with a cross-sectional surface area of piston head 214 that can be referred to as piston head area and is equal to $$A_H = \pi \frac{D_H^2}{4}.$$

On the other hand, fluid in the second chamber 222 interacts with an annular surface area of the piston 212 that can be referred to as piston annular area $$A_{Annular} = \pi \frac{D_H^2 - D_R^2}{4}.$$

The area $A_{Annular}$ is smaller than the piston head area $A_H$. As such, as the piston 212 extends (e.g., moves to the right in FIG. 2) or retracts (e.g., moves to the left in FIG. 2) within the cylinder 210, the amount of fluid flow $Q_H$ going into or being discharged from the first chamber 220 is greater than the amount of fluid flow $Q_{Annular}$ being discharged from or going into the second chamber 222. Particularly, if the piston 212 is moving at a particular velocity V then $Q_H = A_H V$ is greater than $Q_{Annular} = A_{Annular} V$. The difference in flow can be determined as $Q_H - Q_{Annular} = A_R V$, where $A_R$ is the cross-sectional area of the rod 216 and is equal to $$\pi \frac{D_R^2}{4}.$$

With this configuration, the hydraulic cylinder actuator 204 can be referred to as an unbalanced actuator as fluid flow to/from one chamber thereof is not equal to fluid flow to/from the other chamber.

The EHA 202 is configured to control the rate and direction of hydraulic fluid flow to the hydraulic cylinder actuator 204. Such control is achieved by controlling the speed and direction of an electric motor 224 used to drive a pump 226 configured as a bi-directional fluid flow source. The pump 226 has a first pump port 228 connected by a fluid flow line 230 to the first chamber 220 of the hydraulic cylinder actuator 204 and a second pump port 232 connected by a fluid flow line 234 to the second chamber 222 of the hydraulic cylinder actuator 204. The term "fluid flow line" is used throughout herein to indicate one or more fluid passages, conduits or the like that provide the indicated connectivity.

The first pump port 228 and the second pump port 232 are configured to be both inlet and outlet ports based on direction of rotation of the electric motor 224 and the pump 226. As such, the electric motor 224 and the pump 226 can rotate in a first rotational direction to withdraw fluid from the first pump port 228 (inlet port in this case) and pump fluid to the second pump port 232 (outlet port in this case), or conversely rotate in a second rotational direction to withdraw fluid from the second pump port 232 (inlet port in this case) and pump fluid to the first pump port 228 (outlet port in this case).

As depicted in FIG. 2, the pump 226 and the hydraulic cylinder actuator 204 are configured in a closed-circuit, i.e., a closed-loop hydraulic circuit. The term "closed-circuit" is used herein to indicate that fluid is being recirculated in a loop between the pump 226 and the hydraulic cylinder actuator 204. Particularly, in the EHA 202, the pump 226 provides fluid through the first pump port 228 to the workport 215 or through the second pump port 232 to the workport 217, and fluid being discharged from the other workport returns to the corresponding port of the pump 226. As such, fluid is being recirculated between the pump 226 and the hydraulic cylinder actuator 204. In contrast to a closed-circuit, an open-circuit or open loop circuit involves a pump drawing fluid from a reservoir and then providing fluid to the actuator, but fluid discharged from the actuator returns to the reservoir rather than flowing to the inlet port of the pump.

In an example, the pump 226 can be a fixed displacement pump and the amount of fluid flow provided by the pump 226 is controlled by the speed of the electric motor 224 (i.e., by rotational speed of an output shaft of the electric motor 224 coupled to an input shaft of the pump 226). For example, the pump 226 can be configured to have a particular pump displacement $P_D$ that determines the amount of fluid generated or provided by the pump 226 in, for example, cubic inches per revolution ($in^3$/rev). The electric motor 224 can be running at a commanded speed having units of revolutions per minute (RPM). As such, multiplying the speed of the electric motor 224 by $P_D$ determines the fluid flow rate Q in cubic inches per minute ($in^3$/min) provided by the pump 226 to the hydraulic cylinder actuator 204.

The flow rate Q in turn determines the linear speed of the piston 212. For instance, if the electric motor 224 is rotating the pump 226 is a first rotational direction to provide fluid to the first chamber 220, the piston 212 can extend at a speed $$V_1 = \frac{Q}{A_H}.$$

On the other hand, if the electric motor 224 is rotating the pump 226 is a second rotational direction to provide fluid to the second chamber 222, the piston 212 can retract at a speed $$V_2 = \frac{Q}{A_{Annular}}.$$

As depicted in FIG. 2, the hydraulic cylinder actuator 208 can be configured similar to the hydraulic cylinder actuator 204 and can be coupled to a respective load 236. The EHA 206 can also be configured similar to the EHA 202 and can include a respective pump 238 (similar to the pump 226) having a respective first pump port 237 and a respective second pump port 239 and controlled by a respective electric motor 240 (similar to the electric motor 224).

As mentioned above, the hydraulic cylinder actuator 204 is unbalanced such that the amount of fluid flow rate provided to or discharged from the first chamber 220 is greater than the amount of fluid flow rate provided to or discharged from the second chamber 222. As such, the amount of fluid flow rate provided from or received at the first pump port 228 to or from the first chamber 220 is greater than the amount of fluid flow rate provided from or received at the second pump port 232 to or from the second chamber 222. Such discrepancy between the fluid flow rate provided by the pump 226 and fluid flow rate received thereat can cause cavitation and the pump 226 might not operate properly.

The EHA 202 includes a boost circuit 242 configured to boost the fluid flow rate, or consume any excess flow, to make up for such discrepancy in fluid flow rate. The boost circuit 242 can, for example, include a charge pump that is configured to draw fluid from a reservoir 244 and provide the flow to a boost flow line 246. The reservoir 244 can be configured as a fluid storage containing fluid at a low pressure level, e.g., 75-100 pound per square inch (psi). In another example, the boost circuit 242 can comprise an accumulator configured to store pressurized fluid, and the reservoir 244 might not be used. The boost circuit 242 can also be configured to receive excess fluid flowing through the boost flow line 246 and provide a path for such excess fluid to the reservoir 244.

The EHA 202 can include a check valve 247. The check valve 247 can be configured to block fluid provided by the pump 226 via the pump port 228 such the fluid is diverted to the first chamber 220 and extend the piston 212. In examples, the check valve 247 can be electronically-controlled, such if the piston 212 is retracting and it is desired to provide excess flow to the boost circuit 242, the check valve 247 can be switched to an open state that allows excess flow from the first chamber 220 to flow to the boost circuit 242.

As depicted in FIG. 2, the hydraulic system 200 can include a controller 248. The controller 248 can include one or more processors or microprocessors and may include data storage (e.g., memory, transitory computer-readable medium, non-transitory computer-readable medium, etc.). The data storage may have stored thereon instructions that, when executed by the one or more processors of the controller 248, cause the controller 248 to perform operations described herein.

The controller 248 can receive input information comprising sensor information via signals from various sensors or input devices, and in response provide electrical signals to various components of the EHA 202. For example, the controller 248 can receive a command or an input (e.g., from the joysticks 122, 124 of the excavator 100) to move the piston 212 in a given direction at a particular desired speed (e.g., to extend or retract the piston 212). The controller 248 can also receive sensor information indicative of one or more position of speed of the piston 212, pressure levels in various hydraulic lines, chambers, or ports of the EHA 202, magnitude of the load 218, etc. Responsively, the controller 248 can provide command signals to the electric motor 224 via power electronics module 250 to move the piston 212 in the commanded direction and at a desired commanded speed in a controlled manner.

The power electronics module 250 can comprise, for example, an inverter having an arrangement of semiconductor switching elements (transistors) that can support conversion of direct current (DC) electric power provided from a battery 252 of the excavator 100 to three-phase electric power capable of driving the electric motor 224. The battery 252 can also be electrically-coupled to the controller 248 to provide power thereto and receive commands therefrom. In other examples, if the excavator 100 is propelled by an internal combustion engine (ICE) rather than being electrically propelled via the battery 252, an electric generator can be coupled to the ICE to generate power to the power electronics module 250.

The hydraulic system 200 can include another power electronics module controlling the electric motor 240 and being in communication with the controller 248. The boost circuit 242 can also include a respective power electronics module to control a respective electric motor and charge pump. Such power electronics modules are not shown in FIG. 2 to reduce visual clutter in the drawing.

To extend the piston 212 (i.e., move the piston 212 to the right in FIG. 2), the controller 248 can send a command signal to the power electronics module 250 to operate the electric motor 224 and rotate the pump 226 in a first rotational direction. Fluid is thus provided from the pump port 228 through the fluid flow line 230 to the first chamber 220 to extend the piston 212. As the piston 212 extends, fluid is discharged from the second chamber 222 and flows to the second pump port 232 (closed-circuit configuration).

At the same time, the boost circuit 242 can provide make-up or boost flow through the boost flow line 246, and the boost flow joins fluid discharged from the second chamber 222. The combined flow from the second chamber 222 and the boost circuit 242 then flows to the second pump port 232. The make-up of boost flow rate $Q_{Boost}$ is determined as $Q_{Boost}=A_R V$, where $A_R$ is the cross-sectional area of the rod 216 and Vis the speed of the piston 212 as mentioned above.

As such, the amount of flow rate provided to the pump port 232 is substantially equal to the amount of flow rate provided by the pump 226 through the pump port 228 and the fluid flow line 230 to the first chamber 220. Notably, the fluid returning through the fluid flow line 234 to the pump port 232 from the chamber 222 has a low pressure level, and therefore, the boost flow can be provided at a low pressure level that matches the low pressure level of flow returning to the pump port 232. For example, the boost flow can have a pressure level in the range of 10-35 bar or 145-500 psi, compared to high pressure levels such as 4500 psi that might be provided by the pump 226 to the first chamber 220 to extend the piston 212 against the load 218, assuming the load 218 is resistive.

To retract the piston 212 (i.e., move the piston 212 to the left in FIG. 2), the controller 248 can send a command signal to the power electronics module 250 to operate the electric motor 224 and rotate the pump 226 in a second rotational direction, opposite the first rotational direction. Fluid is thus provided from the pump port 232 through the fluid flow line 234 to the second chamber 222 to retract the piston 212.

Fluid discharged from the first chamber 220 flows at a higher flow rate compared to fluid provided to the second chamber 222. Excess flow returning from the first chamber 220 can flow to the boost flow line 246, and then to the boost circuit 242, which can provide a flow path to the reservoir 244. The excess flow rate can be determined as $Q_{Excess}=A_R V$. As such, the amount of flow rate of fluid returning to the pump port 228 from the first chamber 220 is substantially equal to the amount of flow provided by the pump 226 through the pump port 232 and the fluid flow line 234 to the second chamber 222, while excess flow from the first chamber 220 is provided to the boost flow line 246.

The EHA 206 can control operation of the piston of the hydraulic cylinder actuator 208 in a similar manner to extend or retract the piston. As such, the hydraulic system 200 comprises an on-demand, closed-circuit system with a dedicated hydrostatic pump (i.e., the pumps 226, 238) and electric motor (i.e., the electric motors 224, 240) for each hydraulic cylinder actuator 204, 208. This approach can enhance efficiency by eliminating valve metering characterizing conventional systems.

However, having the boost circuit 242 dedicated to provide boost flow and receive excess flow, where the boost circuit 242 can include an additional boost pump and associated fluid connections, adds cost and complexity to a hydraulic system. It may be desirable to configure the hydraulic system of a machine without a dedicated boost system, but rather configure the hydraulic system in a manner that utilizes existing pumps and motors to provide the boost flow, thereby reducing the cost of the system and increasing its efficiency.

Further, having a dedicated closed-circuit for each machine actuator without enabling flow sharing and flow summation between the actuators can render the system having excess flow capacity and oversized components. For instance, if one of the hydraulic cylinder actuators 204, 208 is commanded to move a respective load, while the other is not, then the one that is not commanded remains idle with its capacity to provide flow not being used. It may thus be desirable in some cases to operate one or both of the EHAs 202, 206 in an open-circuit configuration that fluidly connects the pumps 226, 238 in parallel to enable flow summation and enhance utilization of the pumps and motors of the system. This way, smaller pumps can be used in some cases.

Figure 3:
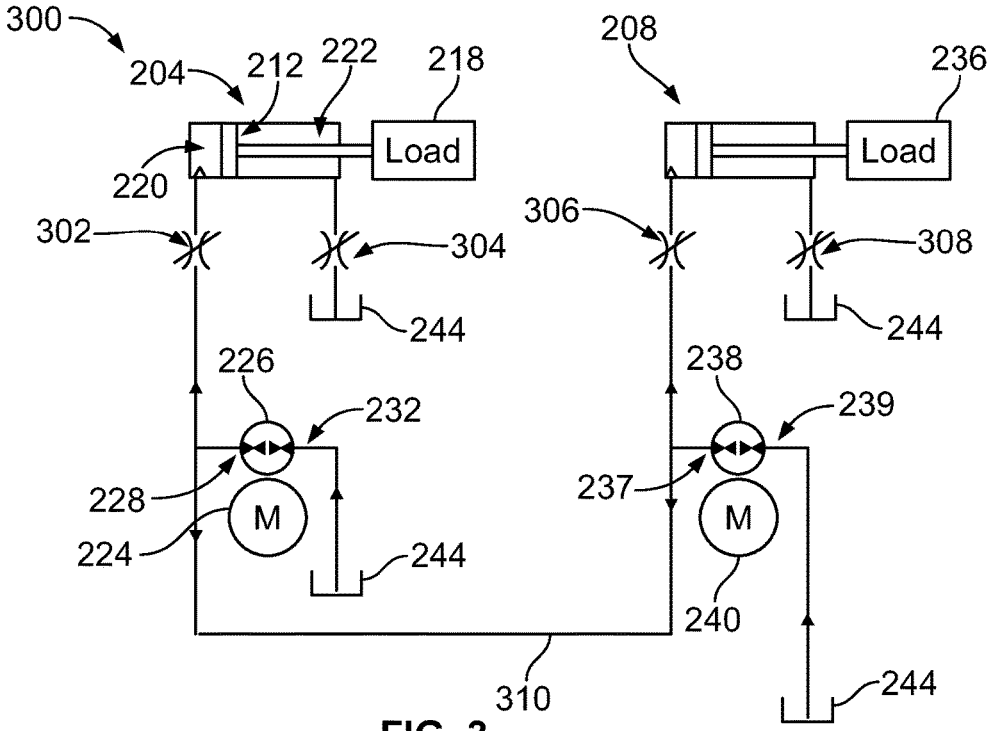
FIG. 3 illustrates a hydraulic system having an open-circuit configuration enabling flow summation, in accordance with an example implementation.

FIG. 3 illustrates a hydraulic system 300 having an open-circuit configuration enabling flow summation, in accordance with an example implementation. The hydraulic system 300 is depicted in a simplified form showing a state involving extension of the pistons of the hydraulic cylinder actuators 204, 208 to illustrate flow summation. However, it should be understood that the hydraulic system 300 can include directional valves that can be actuated to enable retraction of the pistons as described below with respect to the hydraulic system 500. Further, the reservoir 244 is shown in multiple locations in the hydraulic system 300, but is designated with the same reference number throughout FIG. 3.

The hydraulic system 300 includes a variable orifice 302 that can fluidly couple the pump port 228 to the first chamber 220 of the hydraulic cylinder actuator 204, and a variable orifice 304 that fluidly couples the second chamber 222 to the reservoir 244. The variable orifices 302, 304 are depicted schematically in FIG. 3; however, it should be understood that they can be formed by directional, proportional valves that can be electrically-actuated, for example. The variable orifices 302, 304 can be comprised in separate valves or one directional valve. The hydraulic system 300 further includes variable orifice 306 and variable orifice 308 that are fluidly coupled to the hydraulic cylinder actuator 208 and operate in a manner similar to the variable orifices 302, 304.

In contrast to the hydraulic system 200 having the pumps 226, 238 configured in a closed-circuit configuration, the hydraulic system 300 has the pumps 226, 238 configured in an open-circuit configuration. Particularly, the pump port 228 of the pump 226 is fluidly coupled to the pump port 237 of the pump 238 via fluid flow line 310, whereas the pump port 232 of the pump 226 and the pump port 239 of the pump 238 are fluidly coupled to the reservoir 244. This way, fluid discharged from the hydraulic cylinder actuators 204, 208 as their respective pistons extend does not return to the pumps 226, 238 in a closed loop manner like the hydraulic system 200. Rather, fluid discharged from the hydraulic cylinder actuators 204, 208 returns to the reservoir 244. Then, the pumps 226, 238 draw fluid from the reservoir 244 and push the fluid to the hydraulic cylinder actuators 204, 208 to extend the pistons.

For instance, assuming that an operator provides a command to extend the piston 212, the controller 248 can actuate the electric motor 224 to drive the pump 226. The pump 226 draws fluid from the reservoir 244 through the pump port 232 and pushes the fluid to the pump port 228. The controller 248 also opens the variable orifice 302 to open a fluid path to the first chamber 220 to extend the piston 212 and opens the variable orifice 304 to form a fluid path to provide fluid discharged from the second chamber 222 to the reservoir 244.

Notably, with the configuration of the hydraulic system 300, the pump port 237 of the pump 238 is fluidly coupled to the pump port 228 of the pump 226 via fluid flow line 310. This way, the pumps 226, 238 are connected in parallel. As such, fluid output of the pump 238 can join, be added to, or summed with, the fluid output of the pump 226 before flowing to the first chamber 220 of the hydraulic cylinder actuator 204 to extend the piston 212. Similarly, fluid output of the pump 226 can join, be added to, or summed with, the fluid output of the pump 238 before flowing to the hydraulic cylinder actuator 208 to extend its piston.

This way, a total amount of flow available based on maximum allowed speeds of the electric motors 224, 240 driving the pumps 226, 238 can be distributed between the hydraulic cylinder actuators 204, 208 depending on the commanded speeds for their respective pistons. For example, assume that the piston 212 of the hydraulic cylinder actuator 204 is commanded to move at a higher speed compared to the piston of the hydraulic cylinder actuator 208. In this example, the controller 248 can open the variable orifices 302, 306 to different opening sizes such that a portion of fluid pushed by the pump 238 through the pump port 237 flows to the hydraulic cylinder actuator 208 to extend its piston. The remaining portion of the fluid flows through the fluid flow line 310 to join the fluid pushed by the pump 226 through the pump port 228 and flow through the variable orifice 302 to the first chamber 220 and extend the piston 212. This configuration can enable reducing individual pump capacity of the pumps 226, 238 as it enables flow summation between the two pumps 226, 238. As such, smaller, and less costly components can be used compared to the hydraulic system 200.

In other examples, it may be desirable to have a system configuration that enables pressure summation. The motor torque provided by the electric motors 224, 240 is determined based on difference in pressure between pressure level at an outlet port of the respective pump ($P_{Out}$) and a pressure level at an inlet port of the pump ($P_{In}$). For instance, the torque (and thus the power) that the electric motor 224 provides to the pump 226 to extend the piston 212 and push the load 218 is based on the delta pressure value of ($P_{Out}$–$P_{In}$), wherein $P_{Out}$ is pressure level at the pump port 228 (which is substantially equal to pressure level in the first chamber 220), and $P_{In}$ is pressure level at the pump port 232 (which is substantially equal to pressure level in the second chamber 222). The pressure levels $P_{Out}$, $P_{In}$ can in turn be determined by the magnitude of the load 218.

The higher the delta pressure value ($P_{Out}$–$P_{In}$), the larger the torque and power that the electric motor 224 has to provide to drive the piston 212 and the load 218 at a given speed. It may thus be desirable to operate one or both of the EHAs 202, 206 in an open-circuit configuration that fluidly connects the pumps 226, 238 in series where outlet port of a first pump is connected to inlet port of a second pump to enable pressure summation and reduce the delta pressure value across the second pump. This way, the torque that the motor of the second pump needs to provide can be reduced. Thus, system utilization can be enhanced and smaller size motors can be used in some cases.

Figure 4:
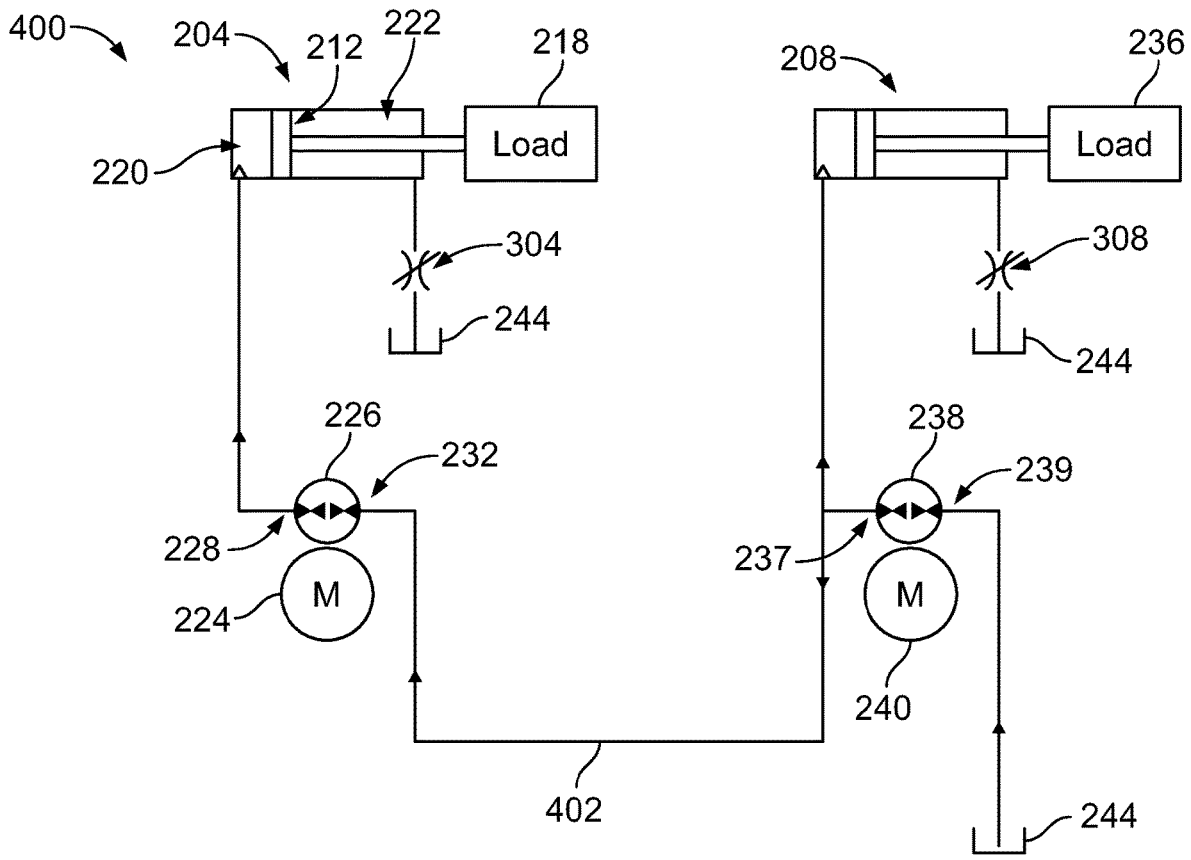
FIG. 4 illustrates a hydraulic system having an open-circuit configuration enabling pressure summation, in accordance with an example implementation.

FIG. 4 illustrates a hydraulic system 400 having an open-circuit configuration enabling pressure summation, in accordance with an example implementation. The hydraulic system 400 is depicted in a simplified form showing a state involving extension of the pistons of the hydraulic cylinder actuators 204, 208 to illustrate pressure summation. However, it should be understood that the hydraulic system 400 can include directional valves that can be actuated to enable retraction of the pistons as described below with respect to the hydraulic system 500. Further, the reservoir 244 is shown in multiple locations in the hydraulic system 400, but is designated with the same reference number throughout FIG. 4.

The hydraulic system 400 has the pumps 226, 238 configured in an open-circuit implementation. However, in contrast to the hydraulic system 300 having the pumps 226, 238 connected in parallel where pump outlet ports (the pump port 228 of the pump 226 and the pump port 237) are fluidly connected, in the hydraulic system 400 the pumps 226, 238 are connected in series. Particularly, the pump port 237 (outlet port of the pump 238 when the associated piston is extending) is connected to the pump port 232 (the inlet port of the pump 226 when the piston 212 is extending) via fluid flow line 402.

As such, fluid output of the pump 238 is provided to the inlet port of the pump 226. This way, the pump 238 can provide high pressure fluid to the inlet port of the pump 226, thereby reducing the pressure differential across the pump 226 (i.e., reducing how much the pump 226 needs to pressurize the fluid). As a result of reducing the delta pressure ($P_{out}$–$P_{In}$) across the pump 226, the torque and the power that the electric motor 224 provides to the pump 226 can be reduced. As such power consumption of the hydraulic system 400 can be reduced as well.

Thus, the hydraulic system 200 provides a closed-circuit architecture having dedicated EHAs for each actuator, whereas the hydraulic systems 300, 400 provide an open-circuit architecture that enables flow and pressure summations, respectively. It may be desirable to have a hydraulic system that selectively switches between closed-circuit architecture and open-circuit architecture. Such a system provides flexibility to switch between different modes of operation to optimize efficiency of the system and utilization of components of the system based on operator commands and the conditions of the hydraulic system.

Figure 5:
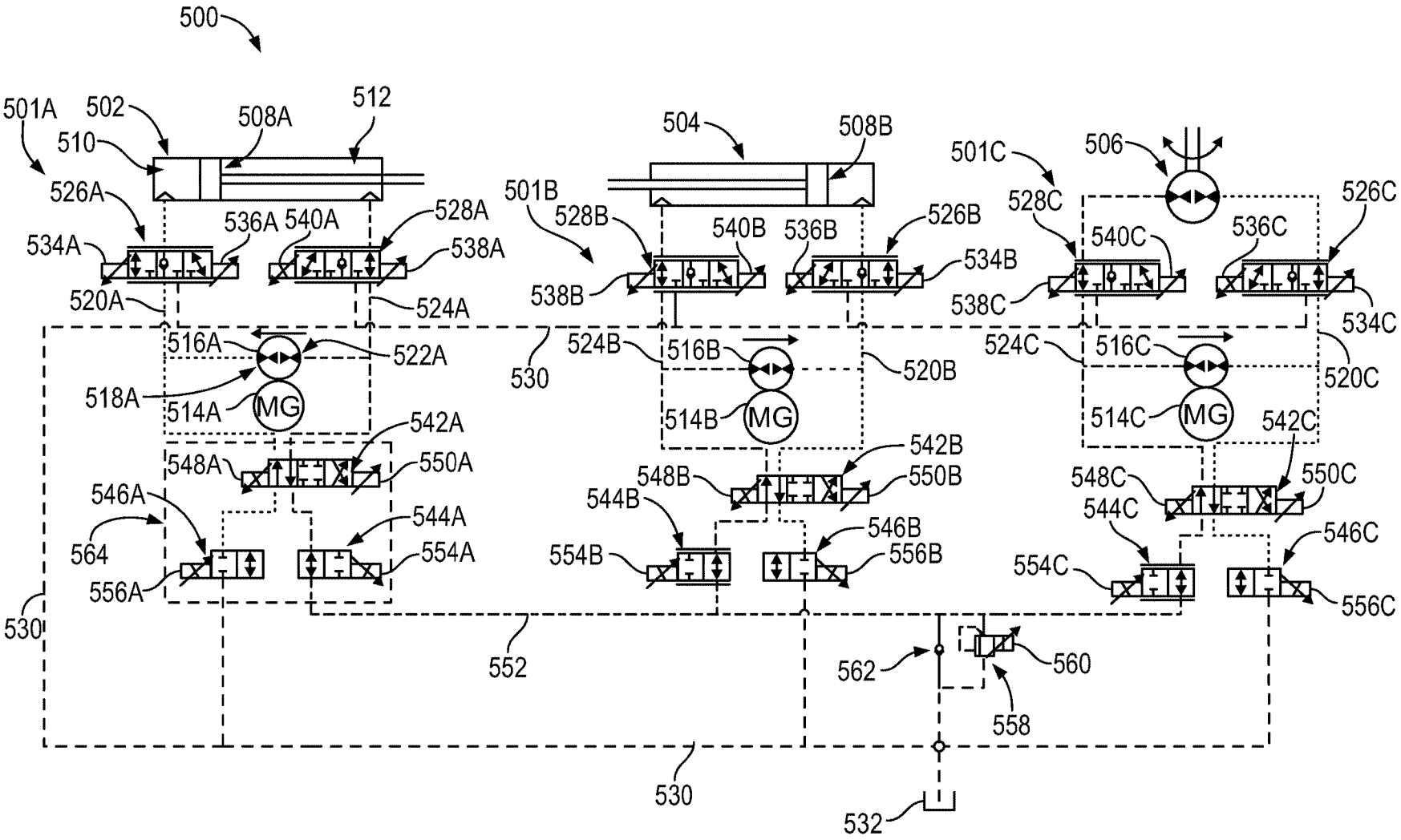
FIG. 5 illustrates a hydraulic system having configuration that enables switching between closed-circuit and open-circuit architectures, in accordance with an example implementation.

FIG. 5 illustrates a hydraulic system 500 having configuration that enables switching between closed-circuit and open-circuit architectures, in accordance with an example implementation. The hydraulic system 500 includes EHAs 501A, 501B, and 501C that control various actuators of a machine. Particularly, the EHAs 501A, 501B are hydraulic cylinder EHAs such that the EHA 501A controls a hydraulic cylinder actuator 502, the EHA 501B controls a hydraulic cylinder actuator 504, whereas the EHA 501C is a hydraulic motor EHA that controls a rotary hydraulic motor actuator 506.

The hydraulic cylinder actuators 502, 504 are configured similar to the hydraulic cylinder actuators 204, 208 and can represent any of the hydraulic cylinder actuators 114, 116, and 118 of the excavator 100. The rotary hydraulic motor actuator 506 can represent, for example, the swing hydraulic motor actuator 120 of the excavator 100. Notably, unlike the unbalanced actuators of the hydraulic cylinder actuators 502, 504, the rotary hydraulic motor actuator 506 is balanced and does not request boost flow when operated.

The EHAs 501A, 501B, and 501C comprise the same components. Therefore, the components or elements of the EHAs 501A, 501B, and 501C are designated with the same reference numbers with an "A," "B," or "C" suffix to correspond to the EHAs 501A, 501B, and 501C, respectively. The EHA 501A is described in detail below and it should be understood that the EHAs 501B and 501C operate in a similar manner.

Further, the controller 248, the power electronics module 250, and the battery 252 are not shown in FIG. 5 to reduce visual clutter in the drawings. However, it should be understood that the hydraulic system 500 can include a controller such as the controller 248 configured to operate and actuate the various components of the hydraulic system 500 such as electric motors and solenoid coils of electrically-actuated valves. Also, it should be understood that the electric motors of the hydraulic system 500 are driven or controlled by respective power electronics modules similar to the power electronics module 250. A battery similar to the battery 252 can also power the various components and modules of the hydraulic system 500.

The hydraulic cylinder actuator 502 is configured similar to the hydraulic cylinder actuator 204 and has a piston 508A having a piston head that divides a cylinder of the hydraulic cylinder actuator 502 into a head-side or first chamber 510 and a rod-side or second chamber 512. The EHA 501A is configured to control the rate and direction of hydraulic fluid flow to the hydraulic cylinder actuator 502. Such control is achieved by controlling the speed and direction of an electric motor 514A (similar to the electric motors 224, 240) configured to drive a pump 516A (similar to the pumps 226, 238) configured as a bi-directional fluid flow source. The pump 516A has a first pump port 518A connected by a fluid flow line 520A to the first chamber 510 of the hydraulic cylinder actuator 502 and a second pump port 522A connected by a fluid flow line 524A to the second chamber 512 of the hydraulic cylinder actuator 502.

The first pump port 518A and the second pump port 522A are configured to be both inlet and outlet ports based on direction of rotation of the electric motor 514A and the pump 516A. As such, the electric motor 514A and the pump 516A can rotate in a first rotational direction to draw fluid through the first pump port 518A and pump the fluid to the second pump port 522A, or conversely rotate in a second rotational direction to draw fluid through the second pump port 522A and pump the fluid to the first pump port 518A.

The EHA 501A further includes a first load-holding valve 526A disposed in the fluid flow line 520A between the first pump port 518A and the first chamber 510. The EHA 501A also includes a second load-holding valve 528A disposed in the fluid flow line 524A between the second pump port 522A and the second chamber 512. The load-holding valves 526A, 528A can be configured as pressure control valves that prevent the piston 508A from moving in an uncontrolled manner. In particular, the load-holding valves 526A, 528A can be configured to operate as check valves that allow free flow from the pump 516A to the chambers 510, 512 while blocking fluid flow from the chambers 510, 512 back the pump 516A until actuated. The term "block" is used throughout herein to indicate substantially preventing fluid flow except for minimal or leakage flow of drops per minute, for example.

As an example, the load-holding valve 526A can be configured as a directional valve that has three ports: a first port fluidly coupled to the first chamber 510, a second port fluidly coupled to the fluid flow line 520A (which is coupled to the pump port 518A), and a third port fluidly coupled to a reservoir fluid line 530 that is fluidly coupled to a reservoir 532 of fluid. The load-holding valve 526A can be an electrically-actuated valve having solenoid actuators comprising solenoid coils 534A, 536A.

When the load-holding valve 526A is in a neutral position or neutral state (i.e., when the solenoid coils 534A, 536A are un-energized), it can allow fluid to flow from the pump 516A (through the pump port 518A and the fluid flow line 520A) through the load-holding valve 526A to the first chamber 510 but blocks fluid discharged from the first chamber 510. When the solenoid coil 534A is energized, the load-holding valve 526A operates in a first state where fluid discharged from the first chamber 510 is allowed to flow therethrough to the fluid flow line 520A then to the pump port 518A of the pump 516A (e.g., closed-circuit configuration). On the other hand, when the solenoid coil 536A is energized, the load-holding valve 526A operates in a second state where fluid discharged from the first chamber 510 is allowed to flow therethrough to the reservoir fluid line 530 (e.g., open-circuit configuration).

The load-holding valve 528A is configured similar to the load-holding valve 526A. Particularly, the load-holding valve 528A can be configured as a directional valve that has three ports: a first port fluidly coupled to the second chamber 512, a second port fluidly coupled to the fluid flow line 524A (which is coupled to the pump port 522A), and a third port fluidly coupled to the reservoir fluid line 530. The load-holding valve 528A can also be an electrically-actuated valve having solenoid actuators comprising solenoid coils 538A, 540A.

When the load-holding valve 528A is in a neutral position or state (i.e., when the solenoid coils 538A, 540A are un-energized), it allows fluid to flow from the pump 516A (through the pump port 522A and the fluid flow line 524A) through the load-holding valve 528A to the second chamber 512 but blocks fluid discharged from the second chamber 512. When the solenoid coil 538A is energized, the load-holding valve 528A operates in a first state where fluid discharged from the second chamber 512 is allowed to flow therethrough to the fluid flow line 524A then to the pump port 522A of the pump 516A (e.g., closed-circuit configuration). On the other hand, when the solenoid coil 540A is energized, the load-holding valve 528A operates in a second state where fluid discharged from the second chamber 512 is allowed to flow therethrough to the reservoir fluid line 530 (e.g., open-circuit configuration).

For example, to extend the piston 508A, the pump 516A can provide fluid flow from the first pump port 518A through the load-holding valve 526A (which might not be actuated as depicted in FIG. 5 or alternatively actuated to the first state by energizing the solenoid coil 534A) to the first chamber 510. Fluid being discharged from the second chamber 512 is blocked by the load-holding valve 528A until the load-holding valve 528A is actuated. For instance, the solenoid coil 538A can be energized to open a fluid flow path from the second chamber 512 to the second pump port 522A and operate the EHA 501A in a closed-circuit configuration as depicted in the state shown in FIG. 5. Alternatively, the load-holding valve 528A can be actuated by energizing the solenoid coil 540A to open a fluid flow path from the second chamber 512 to the reservoir fluid line 530 and operate the EHA 501A in an open-circuit configuration.

Conversely to retract the piston 508A, the pump 516A can provide fluid flow from the second pump port 522A through the load-holding valve 528A (which might not be actuated or actuated to the first state by energizing the solenoid coil 538A) to the second chamber 512. Fluid being discharged from the first chamber 510 is blocked by the load-holding valve 526A until the load-holding valve 526A is actuated. For instance, the solenoid coil 534A can be energized to open a fluid flow path from the first chamber 510 to the first pump port 518A and operate the EHA 501A in a closed-circuit configuration. Alternatively, the load-holding valve 528A can be actuated by energizing the solenoid coil 536A to open a fluid flow path from the first chamber 510 to the reservoir fluid line 530 and operate the EHA 501A in an open-circuit configuration.

In an example, the load-holding valves 526A, 528A can be on/off valves that fully open upon actuation. In another example, it may be desirable to control pressure level of fluid in the chamber (either of the chambers 510, 512) from which fluid is being discharged or apportion fluid being provided to the respective chamber. In this example, the load-holding valves 526A, 528A can be configured as proportional valves that can be modulated to have a particular size opening therethrough that achieves a particular back pressure in the respective chamber from which fluid is being discharged or allow a particular amount of fluid flow rate therethrough.

The hydraulic cylinder actuator 502 is unbalanced such that the amount of fluid flow rate provided to or discharged from the first chamber 510 is greater than the amount of fluid flow rate provided to or discharged from the second chamber 512. As such, the amount of fluid flow rate provided from or received at the first pump port 518A to or from the first chamber 510 is greater than the amount of fluid flow rate provided from or received at the second pump port 522A to or from the second chamber 512 when the EHA 501A operates in a closed-circuit configuration. Such discrepancy between the fluid flow rate provided by the pump 516A and fluid flow rate received thereat can cause cavitation and the pump 516A might not operate properly. The EHA 501A provides for a configuration to boost the fluid flow rate to make up for such discrepancy in fluid flow rate.

The EHA 501A can include a mode switch valve 542A configured to switch mode of operation of the EHA 501A between a closed-circuit mode of operation and an open-circuit mode of operation. The EHA 501A is further configured to have a boost flow valve 544A and a reservoir flow valve 546A that are fluidly coupled to the mode switch valve 542A.

Particularly, the mode switch valve 542A can be configured as a three-position/four-way valve having four ports: (i) a first port fluidly coupled to the reservoir flow valve 546A, (ii) a second port fluidly coupled to the boost flow valve 544A, (iii) a third port fluidly coupled to the fluid flow line 520A and the pump port 518A, and (iv) a fourth port fluidly coupled to the fluid flow line 524A and the pump port 522A. The mode switch valve 542A can be an electrically-actuated valve having solenoid actuators comprising solenoid coils 548A, 550A.

When the mode switch valve 542A is in a neutral position or state (i.e., when the solenoid coils 548A, 550A are un-energized), all four ports are blocked and no fluid passes through the mode switch valve 542A. When the solenoid coil 548A is energized, the mode switch valve 542A can operate in a first state (depicted in FIG. 5) where the mode switch valve 542A fluidly couples the fluid flow line 520A to the reservoir flow valve 546A and fluidly couples the fluid flow line 524A to the boost flow valve 544A. On the other hand, when the solenoid coil 550A is energized, the mode switch valve 542A can operate in a second state where it fluidly couples the fluid flow line 520A to the boost flow valve 544A and fluidly couples the fluid flow line 520A to the reservoir flow valve 546A.

In examples, the boost flow valve 544A can be configured as a two-position/two-way valve having two ports: a first port fluidly coupled to a boost flow line 552, and a second port fluidly coupled to the second port of the mode switch valve 542A. The boost flow valve 544A can be electrically-actuated having a solenoid actuator comprising a solenoid coil 554A. In the example implementation shown in FIG. 5, the boost flow valve 544A can be a normally-open valve that, when unactuated (first state), fluidly couples the mode switch valve 542A to the boost flow line 552. When the solenoid coil 554A is energized, however, the boost flow valve 544A operates in a second state where it blocks fluid flow between the mode switch valve 542A and the boost flow line 552.

Similarly, in examples, the reservoir flow valve 546A can be configured as a two-position/two-way valve having two ports: a first port fluidly coupled to the reservoir fluid line 530, and a second port fluidly coupled to the first port of the mode switch valve 542A. The reservoir flow valve 546A can be electrically-actuated having a solenoid actuator comprising a solenoid coil 556A. In the example implementation shown in FIG. 5, the reservoir flow valve 546A can be a normally-open valve that, when unactuated (first state), fluidly couples the mode switch valve 542A to the reservoir fluid line 530. When the solenoid coil 556A is energized, however, the reservoir flow valve 546A operates in a second state where it blocks fluid flow between the mode switch valve 542A and the reservoir fluid line 530.

The hydraulic system 500 is configured such that, rather than having a dedicated boost system that can provide boost flow to the unbalanced actuators, actuators that have excess flow capacity can provide their excess flow to the boost flow line 552 to feed the unbalanced actuators that requests boost flow. This can be achieved by changing the states of the load-holding valves, the mode switch valves, the boost flow valves, and the reservoir flow valves of the EHAs 501A, 501B, and 501C.

For example, if both pistons of the hydraulic cylinder actuators 502, 504 are extending and therefore need boost flow, pump 516C of the rotary hydraulic motor actuator 506 can provide the boost flow (e.g., the pump 516C can provide fluid through the fluid flow line 524C, the mode switch valve 542C actuated by the solenoid coil 548C, and the boost flow valve 544C in its normally-open state, to the boost flow line 552). In particular, the controller of the hydraulic system 500 (e.g., the controller 248) can determine the amount of flow rate requested by the unbalanced actuators and command the electric motor 514C to rotate at a particular speed that generates the requested amount of fluid flow rate requested.

In some cases, the operator of the machine (e.g., operator of the excavator 100) commands the rotary hydraulic motor actuator 506 to move (e.g., rotate the rotating platform 110) at a given seed at the same time the unbalanced actuators (the hydraulic cylinder actuators 502, 504) are actuated. In these cases, the controller can determine the amount of flow rate requested by the unbalanced actuators as well as the amount of flow rate requested to operate the rotary hydraulic motor actuator 506, and then command the electric motor 514C to rotate at a particular speed that generates the total amount of flow.

Further, the hydraulic system 500 can allow excess flow returning from some of the unbalanced actuators whose pistons is retracting to be used by other unbalanced actuators whose pistons are extending. For example, if the piston 508A of the hydraulic cylinder actuator 502 is retracting, excess flow discharged from the first chamber 510 (and not consumed by the pump 516A) can be provided to the boost flow line 552 (e.g., by energizing the solenoid coil 534A of the load-holding valve 526A, the solenoid coil 550A if the mode switch valve 542A). If the piston 508B is extending and thus boost flow is requested by the hydraulic cylinder actuator 504, the excess flow provided by the hydraulic cylinder actuator 502 to the boost flow line 552 can be consumed by the hydraulic cylinder actuator 504 as boost flow.

In examples, it may be desirable to provide boost fluid flow at a particular pressure level. For instance, if the piston 508A is extending and thus boost flow is requested, boost flow can provided from the boost flow line 552 to the boost flow valve 544A, which is in an unactuated state, then through the mode switch valve 542A, which is actuated by energizing the solenoid coil 548A, to then join the returning flow discharged from the second chamber 512 before flowing to the pump port 522A. To have the boost flow at a pressure level that is substantially equal to pressure level of fluid discharged from the second chamber 512, the hydraulic system 500 can include an electro-hydraulic pressure relief valve (EHPRV) 558 configured to control pressure level of fluid in the boost flow line 552.

The EHPRV 558 fluidly couples the boost flow line 552 to the reservoir 532 as shown in FIG. 5. The EHPRV 558 can, for example, include a mechanical relief portion and an electrohydraulic proportional portion having a solenoid coil 560. As an example, the mechanical relief portion can have a movable element (e.g., a poppet) that is biased by a spring to be seated at a seat formed within a valve body or sleeve in the EHPRV 558. The spring determines a pressure setting of the EHPRV 558.

When pressure level of fluid in the boost flow line 552 exceeds a particular pressure level, i.e., the pressure setting of the EHPRV 558, the movable member overcomes the spring and is lifted off a seat, thereby causing fluid to flow from the boost flow line 552 to the reservoir 532. As a result, pressure level in the boost flow line 552 does not exceed the pressure setting of the EHPRV 558.

The electrohydraulic proportional portion of the EHPRV 558 can include, for example, a proportional two way valve. When an electric signal is provided to the solenoid coil 560, a spool or movable element in the electrohydraulic proportional portion moves and allows a fluid signal to be provided to the mechanical relief portion. The fluid signal varies the pressure setting determined by the spring of the mechanical relief portion based on a magnitude of the electrical signal supplied to the solenoid coil 560. As the magnitude of the signal is increased, for example, the pressure setting increases and vice versa. With this configuration, the pressure level of the boost fluid flow in the boost flow line 552 can be controlled and varied by the electric signal to the solenoid coil 560.

The hydraulic system 500 can further have a check valve 562 that blocks fluid flow from the boost flow line 552 to the reservoir 532 to enable the EHPRV 558 to control pressure level in the boost flow line 552. The check valve 562 can, however, provided a flow path for fluid from the reservoir to the boost flow line 552 if pressure level in the boost flow line 552 drops below a particular pressure level (e.g., 70 psi) to prevent cavitation in the boost flow line 552.

It should be understood that functionality of multiple valves in the hydraulic system 500 can be integrated into one valve or manifold, and conversely, functionality of a single valve can be separate into multiple valves. For instance, the mode switch valve 542A, 542B, 542C can be integrated with one or both of the reservoir flow valve 546A, 546B, 546C and the boost flow valve 544A, 544B, and 544C) into a single valve, package, or manifold. Similarly, operations of a valve (e.g., the mode switch valves 542A, 542B, and 542C) can be separated into multiple valves.

As such, the mode switch valve 542A, 542B, or 542C, the reservoir flow valve 546A, 546B, or 546C, and the boost flow valve 544A, 544B, and or 544C can be referred to collectively as a valve assembly configured to perform the operations of these valves. For instance, the mode switch valve 542A, the reservoir flow valve 546A, and the boost flow valve 544A of the hydraulic cylinder actuator 502 can be referred to collectively as a valve assembly 564. The valve assembly 564 can operate in a plurality of state based on respective states of the mode switch valve 542A, the reservoir flow valve 546A, and the boost flow valve 544A. Based on the state of the valve assembly 564, the EHA 501A can operate in multiple states. In examples, the load-holding valves 526A, 528A can be included in the valve assembly 564.

Other valve assemblies corresponding to the hydraulic cylinder actuator 504 and the rotary hydraulic motor actuator 506 are not designated in the FIG. 5 to reduce visual clutter in the drawing. It should be understood, however, that the mode switch valve 542B, the reservoir flow valve 546B, and the boost flow valve 544B form a valve assembly for the EHA 501B, and similarly the mode switch valve 542C, the reservoir flow valve 546C, and the boost flow valve 544C form a valve assembly for the EHA 501C.

The hydraulic system 500 as depicted in FIG. 5 illustrates each of the EHAs 501A, 501B, and 501C in a closed-circuit configuration (i.e., the pumps 516A, 516B, and 516B are not fluidly coupled to the reservoir 532). However, the hydraulic system 500 provides operational flexibility. Particularly, in addition to enabling using the actuators as sources of boost flow, rather than having a dedicated boost circuit, the hydraulic system 500 also enables switching between a closed-circuit configuration and an open-circuit configuration based on system condition. Further, in the open-circuit configuration, the hydraulic system 500 can be configured to enable flow summation or pressure summation. As such, the valve assembly 564 and the corresponding valve assemblies of the other actuators can include a configuration of valves that can operate in different states to operate the respective pumps in a close-circuit configuration or an open-circuit configuration as well as enable flow and pressure summation as described below with respect to FIGS. 6, 7, 8, and 9.

Figure 6:
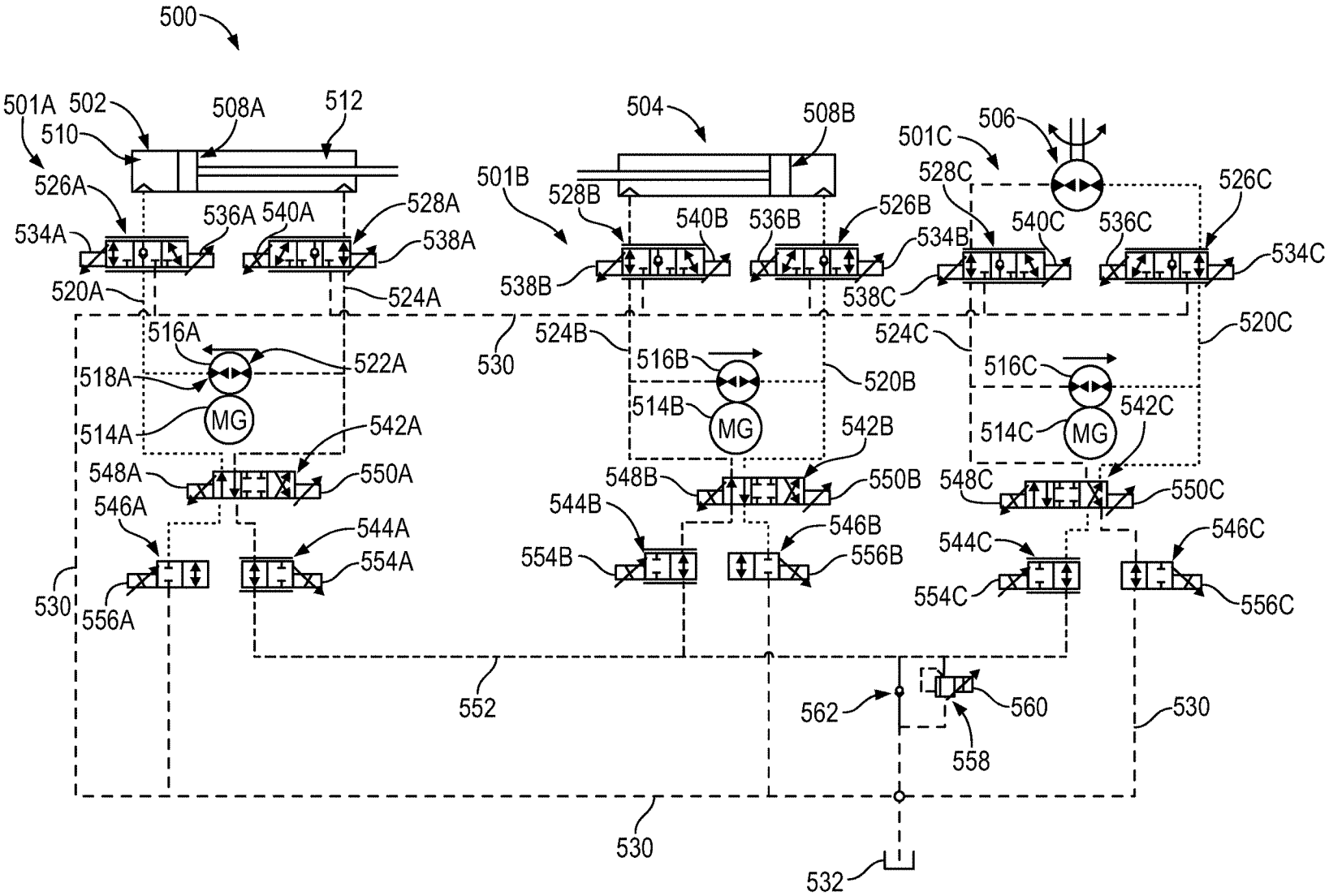
FIG. 6 illustrates the hydraulic system of FIG. 5 with an electro-hydrostatic actuator system (EHA) of a swing hydraulic motor actuator in an open-circuit mode of operation, in accordance with an example implementation.

FIG. 6 illustrates the hydraulic system 500 with the EHA 501C of the rotary hydraulic motor actuator 506 in an open-circuit mode of operation, in accordance with an example implementation. In an example scenario of operation of the hydraulic system 500 shown in FIG. 6, it is assumed that the operator of the machine (e.g., the excavator 100) uses input devices (e.g., the joysticks 122, 124) to request extending the piston 508A of the hydraulic cylinder actuator 502, extending the piston 508B of the hydraulic cylinder actuator 504, and actuating the rotary hydraulic motor actuator 506. The controller (e.g., the controller 248) of the hydraulic system 500 receives from the input devices signals indicative of the operator's commands. In response, the controller can convert the magnitude of the command signals to requested speeds for the pistons 508A, 508B, and the rotary hydraulic motor actuator 506, and accordingly determine the amounts of fluid flow rates that achieve the requested speeds.

The controller can also determine that each of the pumps 516A, 516B can provide sufficient flow to the respective actuators when operating in closed-circuit configuration, and the electric motors 514A, 514B can provide enough torque to drive the pumps 516A, 516B with the pressure levels existing in the hydraulic system 500. As such, the controller can determine that operating in the EHAs 501A, 501B in a closed-circuit mode of operation is optimal. To operate the EHAs 501A, 501B in the closed-circuit mode, the controller can (i) energize the solenoid coils 548A, 548B of the mode switch valves 542A, 542B, and (ii) energize the solenoid coils 556A, 556B of the reservoir flow valves 546A, 546B to block fluid flow between the mode switch valves 542A, 542B and the reservoir fluid line 530.

However, to provide boost flow to the hydraulic cylinder actuators 502, 504, the controller can operate the EHA 501C in an open-circuit mode of operation such that the pump 516C can provide boost flow to the boost flow line 552 in addition to fluid flow to the rotary hydraulic motor actuator 506. To operate the EHA 501C in the open-circuit mode, the controller can energize the solenoid coil 550C of the mode switch valve 542C, while not actuating either of the boost flow valve 544C or the reservoir flow valve 546C. As such, both the boost flow valve 544C and the reservoir flow valve 546C operate in their normally-open state.

Based on the displacements of the pumps 516A, 516B, which can be stored on a memory of the controller, the controller provides motor command signals to the electric motors 514A, 514B to rotate at respective rotational speeds, and thus rotate the pumps 516A, 516B at the respective rotational speeds to provide the determined amounts of fluid flow rates and extend the pistons 508A, 508B.

Referring to the EHA 501A, the controller further actuates the load-holding valve 528A by energizing the solenoid coil 538A to allow fluid discharged from the second chamber 512 of the hydraulic cylinder actuator 502 to flow therethrough back to pump 516A. Because the piston 508A is extending, boost flow is required to join the returning fluid discharged from the second chamber 512 before flowing together to the pump port 522A. Assuming that the commanded velocity for the piston 508A is $V_1$ and the cross-sectional area of the rod of the piston 508A is $A_{Rod_1}$, the boost flow rate can be determined by the controller to be $V_1 \cdot A_{Rod_1}$.

Similarly, referring to the EHA 501B, the controller actuates the load-holding valve 528B by energizing the solenoid coil 538B to allow fluid discharged from the rod-side chamber of the hydraulic cylinder actuator 504 to flow therethrough back to pump 516B. Because the piston 508B is extending, boost flow is required to join the returning fluid discharged from the rod-side chamber before flowing together to the inlet port of the pump 516B. Assuming that the commanded velocity for the piston 508B is $V_2$ and the cross-sectional area of the rod of the piston 508B is $A_{Rod_2}$, the boost flow rate can be determined by the controller to be $V_2 \cdot A_{Rod_2}$.

The operator can use the input device to command rotation of the rotating platform 110 at a particular rotational speed $\omega_{swing}$. The controller then determines an amount of fluid flow rate $Q_{swing}$ to be provided to the rotary hydraulic motor actuator 506 and achieve the speed $\omega_{swing}$.

Based on the displacements of the pump 516C, which can be stored on a memory of the controller, the controller provides motor command signals to the electric motor 514C to rotate at a respective rotational speed, and thus rotate the pump 516C at the respective rotational speeds to provide an amount of flow that is sufficient to both rotate the rotary hydraulic motor actuator 506 at the commanded speed and provide the boost flow required by the and command the hydraulic cylinder actuators 502, 504, i.e., provide a total flow rate $Q_{Total}=Q_{Swing}+V_1 \cdot A_{Rod_1}+V_2 \cdot A_{Rod_2}$.

Referring to the EHA 501C, the controller actuates the mode switch valve 542C by energizing the solenoid coil 550C but does not actuated the reservoir flow valve 546C (i.e., the solenoid coil 556C is un-energized) to operate the EHA 501C in an open-circuit mode of operation. In particular, by energizing the solenoid coil 550C, the mode switch valve 542C operates in the state depicted in FIG. 6 where it fluidly couples the fluid flow line 524C to the reservoir flow valve 546C (which is in its normally-open state), and thus the fluid flow line 524C is fluidly coupled to the reservoir fluid line 530.

The controller does not actuate the boost flow valve 544C (i.e., the solenoid coil 554C is un-energized) either. As such, the fluid flow line 520C is fluidly coupled to the boost flow line 552 via the mode switch valve 542C and the boost flow valve 544C (which is in its normally-open state).

The controller can further actuate the load-holding valve 528C by energizing the solenoid coil 538C to allow fluid discharged from the rotary hydraulic motor actuator 506 to flow therethrough back to pump 516B. Further, the controller actuates the load-holding valve 526C and by energizing the solenoid coil 534C. As mentioned above, the load-holding valve 526C is configured as a proportional valve, and thus the controller can actuate the solenoid coil 534C proportional to the commanded speed of the rotary hydraulic motor actuator 506. This way, fluid provided by the pump 516C can be apportioned or divided such that a portion of fluid flows to the rotary hydraulic motor actuator 506 via the load-holding valve 526C at a flow rate of $Q_{swing}$ and the remaining portion of fluid flows to the mode switch valve 542C.

As mentioned above, by actuating the mode switch valve 542C to the state shown in FIG. 6 (i.e., by energizing the solenoid coil 550C) and not actuating the boost flow valve 544C a flow path is open for boost flow from the pump 516C to the boost flow line 552 through the mode switch valve 542C and the boost flow valve 544C. Particularly, the pump 516C can provide fluid at a flow rate of $V_1 \cdot A_{Rod_1}+V_2 \cdot A_{Rod_2}$ to the boost flow line 552. Further, to open a flow path from the boost flow line 552 to the mode switch valves 542A, 542B of the hydraulic cylinder actuators 502, 504 and provide boot flow thereto, the boost flow valves 544A, 544B are not actuated (i.e., the solenoid coils 554A, 554B are un-energized).

As a result, a boost fluid at a flow rate of $V_1 \cdot A_{Rod_1}$ can be provided to the hydraulic cylinder actuator 502, and a boost fluid at a flow rate of $V_2 \cdot A_{Rod_2}$ can be provided to the hydraulic cylinder actuator 504. The controller can further provide an electric command signal to the EHPRV 558 to maintain a particular pressure level in the boost flow line 552 that is substantially equal to the higher of the pressure levels of fluid returning to the pumps 516A, 516B from their respective hydraulic cylinder actuator.

In some cases, the total flow rate $Q_{Total}$ requested for the boost flow line 552 in addition to the fluid flow rate requested by the rotary hydraulic motor actuator 506 to achieve the speed $\omega_{swing}$ can exceed the maximum allowed fluid flow rate $Q_{Max}$ that the pump 516C can supply based on its pump displacement and maximum allowed motor speed of the electric motor 514C. In these cases, the controller can determine a speed reduction factor equal to $$\frac{Q_{Max}}{Q_{Total}},$$

which results in a value less man 1. The controller can then multiply the speed command $V_1$ for the piston 508A, the speed command $V_2$ for the piston 508B, and the swing command $\omega_{swing}$ for the rotary hydraulic motor actuator 506 by the speed reduction factor to determine modified commands $V_{1_Modified}$, $V_{2_Modified}$, and $\omega_{Swing_Modified}$ that are less than the original commands $V_1$, $V_2$, and $\omega_{swing}$, respectively. The controller can then use the modified commands to determine the amounts of fluid flow rate requested for the boost flow line 552 and the rotary hydraulic motor actuator 506, such that these amounts would not exceed that maximum allowed flow rate $Q_{Max}$ of the pump 516C.

With this configuration, operating the machine (e.g., excavator 100) does not involve using a dedicated boost system. Rather, the EHA 501C, and particularly the pump 516C, can operate as a boost system in addition to being configured to operate the rotary hydraulic motor actuator 506. This way, cost and complexity of the hydraulic system 500 may be lower than other systems involving an additional, dedicated boost system involving respective pump, motor, valves, and hydraulic lines.

In an alternative scenario, instead of using the swing pump 516C to provide boost flow, one of the hydraulic cylinder actuator can be used to provide the boost flow. Particularly, the hydraulic cylinder actuator can be operated in an open-circuit mode of operation to allow its respective pump to provide flow to the boost flow line 552.

Figure 7:
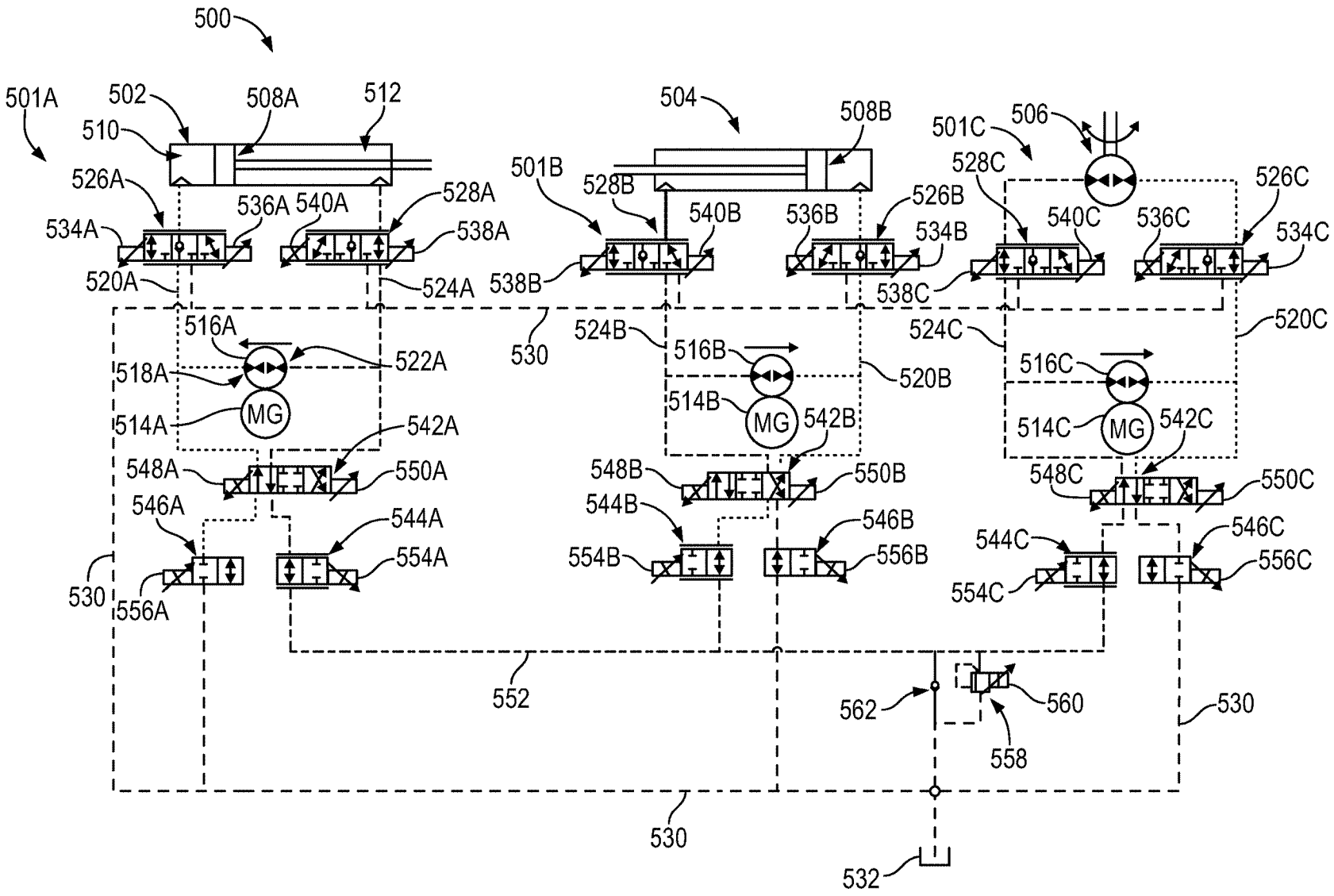
FIG. 7 illustrates the hydraulic system of FIG. 5 with an EHA of a hydraulic cylinder actuator in an open-circuit mode of operation, in accordance with an example implementation.

FIG. 7 illustrates the hydraulic system 500 with the EHA 501B of the hydraulic cylinder actuator 504 in an open-circuit mode of operation, in accordance with an example implementation. In the state of the hydraulic system 500 depicted in FIG. 7, the EHA 501A and the EHA 501C operate in a closed-circuit configuration, whereas the EHA 501B associated with the hydraulic cylinder actuator 504 operates in an open-circuit mode. This state of operation may be determined to be optimal by the controller when, for example, the operator commands: (i) the piston 508A to extend at a high speed that requires the flow capacity of the pump 516A, (ii) the hydraulic motor of the rotary hydraulic motor actuator 506 to rotate at a high rotational speed that requires the flow capacity of the pump 516C, and (iii) the piston 508B to extend at a low speed that does not require the full flow capacity of the pump 516B. Because the pump 516B has excess capacity, the controller can determine to operate the EHA 501B in an open-circuit mode of operation such that excess flow capacity of the pump 516B is provided to the boost flow line 552. This way, the excess capacity of the pump 516B can provide boost flow to the hydraulic cylinder actuator 502.

As shown in FIG. 7, the EHA 501A operates in the same state as in FIG. 7. As such, the EHA 501A operates in a closed-circuit configuration and requires boost flow to join fluid discharged from the second chamber 512 as the piston 508A extends before flowing to the pump port 522A. In contrast to FIG. 6, in FIG. 7 the EHA 501C operates in a closed-circuit state of operation.

Particularly, the solenoid coil 548C of the mode switch valve 542C is energized rather than the solenoid coil 550C. Also the solenoid coils 534C and 538C are energized to allow fluid to flow to and from the rotary hydraulic motor actuator 506 via the load-holding valves 526C, 528C. As such, the pump 516C can provide fluid flow to the fluid flow line 520C and then to the rotary hydraulic motor actuator 506 to rotate it in a particular rotational direction. The solenoid coil 556C of the reservoir flow valve 546C is also energized to block fluid from flowing through the mode switch valve 542C to the reservoir fluid line 530. Fluid discharged from the rotary hydraulic motor actuator 506 flows through the fluid flow line 524C and is drawn to the inlet port of the pump 516C. As mentioned above, the rotary hydraulic motor actuator 506 is balanced and does not require boost flow or provide excess flow when operating in a closed-circuit configuration. The solenoid coil 554C might not be energized such that the boost flow line 552 an provide fluid flow that makes up for any pump or motor leakage to through the boost flow valve 544C to the pump 516C.

To operate the EHA 501B in an open-circuit configuration and provide boost flow to the boost flow line 552: (i) the solenoid coil 550B of the mode switch valve 542B is energized, (ii) the solenoid coil 556B of the reservoir flow valve 546B is energized, and (iii) the solenoid coil 540B of the load-holding valve 528B is energized. With this configuration, the load-holding valve 528B operates in a state where fluid discharged from the rod-side chamber of the hydraulic cylinder actuator 504 flows through the load-holding valve 528B to the reservoir fluid line 530 rather than back to the inlet port of the pump 516B. This way, the EHA 501B operates in an open-circuit configuration. Also, the solenoid coil 556B is un-energized such that the reservoir flow valve 546B opens a fluid path from the reservoir 532 to the inlet pump port of the pump 516B.

Fluid provided by the pump 516B to the fluid flow line 524B can be divided such that a portion of fluid flows through the load-holding valve 526B to the head-side chamber of the hydraulic cylinder actuator 504, and any excess fluid portion flows to the mode switch valve 542B. Because the solenoid coil 550B of the mode switch valve 542B is energized, the mode switch valve 542B fluidly couples the fluid flow line 520B to the boost flow valve 544B. The boost flow valve 544B is not actuated, and therefore fluid provided thereto flows therethrough to the boost flow line 552. Boost flow can then be drawn from the boost flow line 552 through the boost flow valve 544A and the mode switch valve 542A of the EHA 501A to join fluid returning from the second chamber 512 before flowing to the pump port 522A.

The state shown in FIG. 7 illustrates the hydraulic system 500 provides flexibility that can render any of the actuators (the hydraulic cylinder actuators 502, 504 or the rotary hydraulic motor actuator 506) capable of providing boost flow based on availability of excess capacity. The hydraulic system 500 can further be configured to operate in a pressure summation mode of operation similar to the description above with respect to FIG. 4. As described with respect to FIG. 4, pressure summation mode occurs when outlet flow from a first pump is provided to inlet port of a second pump, thereby increasing pressure level at the inlet of a second pump. Pressure differential across the second pump can thus be decreased, and the motor torque generated by the electric motor controlling the second pump can be reduced as well.

Figure 8:
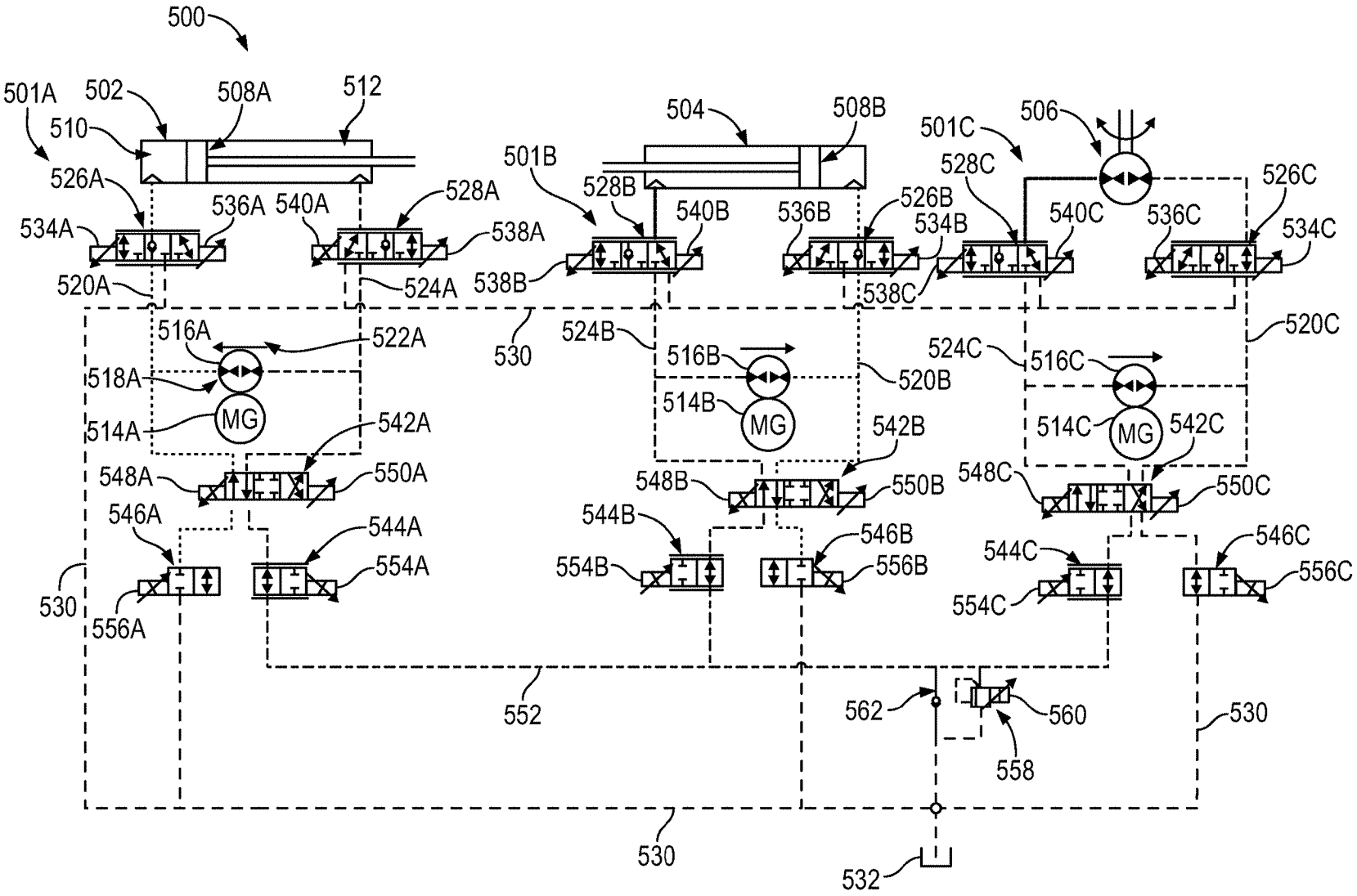
FIG. 8 illustrates the hydraulic system of FIG. 5 operating in a pressure summation mode of operation, in accordance with an example implementation.

FIG. 8 illustrates the hydraulic system 500 operating in a pressure summation mode of operation, in accordance with an example implementation. In the state of the hydraulic system 500 depicted in FIG. 8, the EHA 501C operates in an open-circuit mode of operation so as to provide high pressure fluid to both the rotary hydraulic motor actuator 506 as well as to the boost flow line 552. Particularly, the solenoid coil 550C of the mode switch valve 542C is energized and the reservoir flow valve 546C is not actuated and thus operates in its normally-open state. With this configuration, the pump 516C can draw fluid from the reservoir 532 through the reservoir fluid line 530, the reservoir flow valve 546C, and the mode switch valve 542C. The pump 516C then provides high pressure fluid to the fluid flow line 520C.

The solenoid coil 534C of the load-holding valve 526C is energized proportional to the speed requested for the rotary hydraulic motor actuator 506, such that fluid provided by the pump 516C is apportioned between the rotary hydraulic motor actuator 506 and the boost flow line 552 (the boost flow valve 544C is in its normally-open state and thus fluid can flow from the fluid flow line 524C therethrough to the boost flow line 552). Notably, the solenoid coil 540C of the load-holding valve 528C so as to provide fluid discharged from the rotary hydraulic motor actuator 506 to the reservoir fluid line 530. Thus, with this configuration, the EHA 501C operates in an open-circuit mode of operation and high pressure fluid is provided from the pump 516C to the boost flow line 552.

Regarding the EHA 501A associated with the hydraulic cylinder actuator 502, as the piston 508A extends, fluid discharged from the second chamber 512 flows to the reservoir fluid line 530 because the solenoid coil 540A of the load-holding valve 528A is energized. Thus, fluid discharged from the second chamber 512 does not flow back to the inlet port (the pump port 522A) of the pump 516A. Rather, the pump 516A draws fluid from the boost flow line 552.

Particularly, the boost flow valve 544A is not actuated and thus operates in its normally-open state. The solenoid coil 548A of the mode switch valve 542A is energized, and therefore the fluid flow line 524A (and the pump port 522A) is fluidly coupled to the boost flow line 552 via the mode switch valve 542A and the boost flow valve 544A.

This way, the boost flow line 552 is in series with the inlet port (the pump port 522A) of the pump 516A. Particularly, high pressure fluid provided by the pump 516C to the boost flow line 552 flows to the inlet port (the pump port 522A) of the pump 516A. As such, the EHA 501A can be considered to be operating in an open-circuit mode of operation with the boost flow line 552 in series with the inlet port of the pump 516A. The EHA 501B is also configured in the same manner as the EHA 501A as depicted in FIG. 8.

As described above with respect to FIG. 4, the delta pressure value of ($P_{Out}$–$P_{In}$) across the pumps 516A, 516B are thus reduced. The torques that the electric motors 514A, 514B provide to the pumps 516A, 516B are in turn reduced, thereby reducing power consumption of the hydraulic system 500. The mode of operation shown in FIG. 8 is desirable or optimal, for example, when the commanded speeds of the actuators (the hydraulic cylinder actuators 502, 504 and the rotary hydraulic motor actuator 506) are low such that the flow rates required are small, whereas force required to be exerted by the actuators is high. For instance, if the excavator 100 is in a digging portion of cycle, it may be desirable to apply high forces via the boom 102 and the arm 104 to dig through the ground, but the boom 102 and the arm 104 might be moving slowly while digging.

The hydraulic system 500 can further be configured to operate in a flow summation mode of operation similar to the description above with respect to FIG. 3. As described with respect to FIG. 3, flow summation mode occurs when two pumps are connected in parallel, i.e., when outlet flow from a first pump joins outlet flow of a second pump, thereby increasing total amount of flow available for an actuator.

Figure 9:
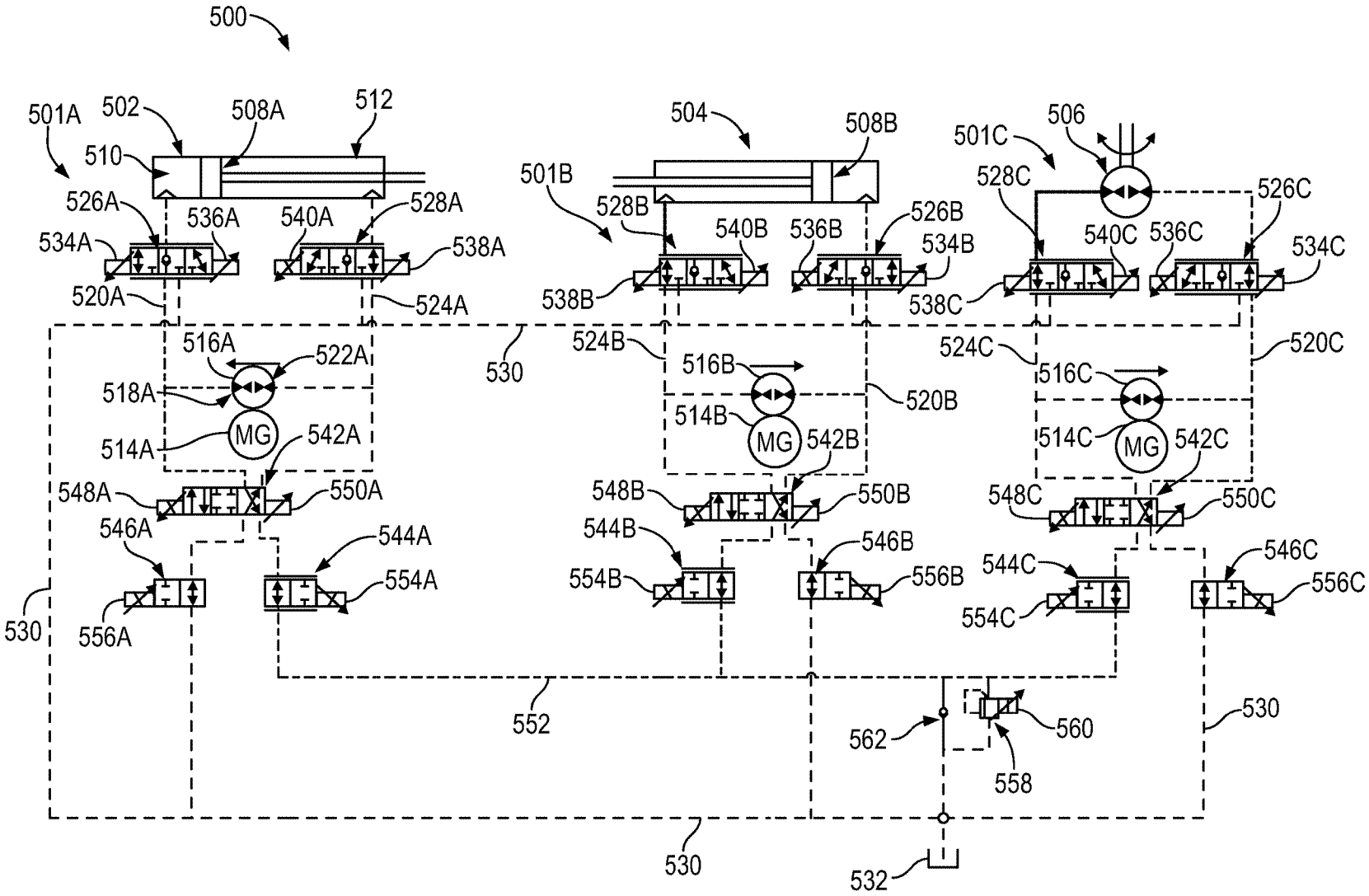
FIG. 9 illustrates the hydraulic system of FIG. 5 operating in a flow summation mode of operation, in accordance with an example implementation.

FIG. 9 illustrates the hydraulic system 500 operating in a flow summation mode of operation, in accordance with an example implementation. In the state of the hydraulic system 500 depicted in FIG. 5, all three EHAs 501, 501B, and 501C are in an open-circuit mode of operation and the pumps 516A, 516B, and 516C are connected in parallel. Particularly, the outlet ports of the pumps 516A, 516B, and 516C are connected to the boost flow line 552, and therefore the output flows can be summed and shared between all three actuators. In the scenario depicted in FIG. 9, the pistons 508A, 508B are extending, and the pump 516C provides output flow to the fluid flow line 520C.

Referring to EHA 501A, the solenoid coil 550A of the mode switch valve 542A is energized to operate the EHA 501A in an open-circuit mode. Particularly, the outlet port (the pump port 518A) of the pump 516A is fluidly coupled via the mode switch valve 542A to the boost flow line 552 (the boost flow valve 544A is in its un-actuated normally open state). This way, fluid being provided by the pump 516A can be divided between the first chamber 510 of the hydraulic cylinder actuator 502 and the boost flow line 552.

The inlet port (the pump port 522A) of the pump 516A and the fluid flow line 524A (to which fluid discharged from the second chamber 512 is provided) are fluidly coupled to the reservoir fluid line 530 via the mode switch valve 542A and the reservoir flow valve 546A (which is in its un-actuated normally open state). The EHAs 501B, 501C are configured in a similar manner.

Thus, outlet ports of the pumps 516A, 516B, and 516C (e.g., the pump port 518A as the piston 508A extends) are fluidly coupled to the boost flow line 552. With this configuration, fluid flows can be shared and summed between all three actuators. For example, if the hydraulic cylinder actuator 502 requires higher flow rate than what the pump 516A can supply, then fluid flow from the pump 516A can be augmented by fluid from the boost flow line 552 provided thereto by one or both of the pumps 516B, 516C. In examples, the pumps 516A, 516B, and 516C can be selectively turned on only when additional flow is required by any of the actuators. As such, individual pump displacements can be reduced, saving pump and motor cost.

As FIGS. 5-9 illustrate, the hydraulic system 500 comprises a dual architecture that enables switching between a closed-circuit mode and open-circuit mode based on machine conditions. This way, the hydraulic system 500 can be tailored to operating conditions of a particular machine and its expected duty cycle, thereby potentially reducing cost while minimizing impact on efficiency.

The hydraulic system 500 enables boost flow that unbalanced actuators require to be provided by pumps of other actuators. Thus, no dedicated boost circuit with its pumps and motors are required. Rather, excess power required by any actuator can be distributed to EHAs of other actuators that have excess capacity depending on the duty cycle.

Open-circuit pressure summation mode (FIG. 8) may lower the total installed machine torque by trading total machine flow for increased boost pressure. Supplying increased boost pressure to the pumps can increase output pressure without increasing motor torque. As a result, the machine can operate in a cost effective low speed, high force/torque operating mode.

Open-circuit flow summation mode (FIG. 9) can lower the total installed pump displacement by enabling parallel pump operation when high speed operation is required. This capability also enables specialized auxiliary functions without sacrificing total machine functionality or adding additional pump/motors.

Figure 10:
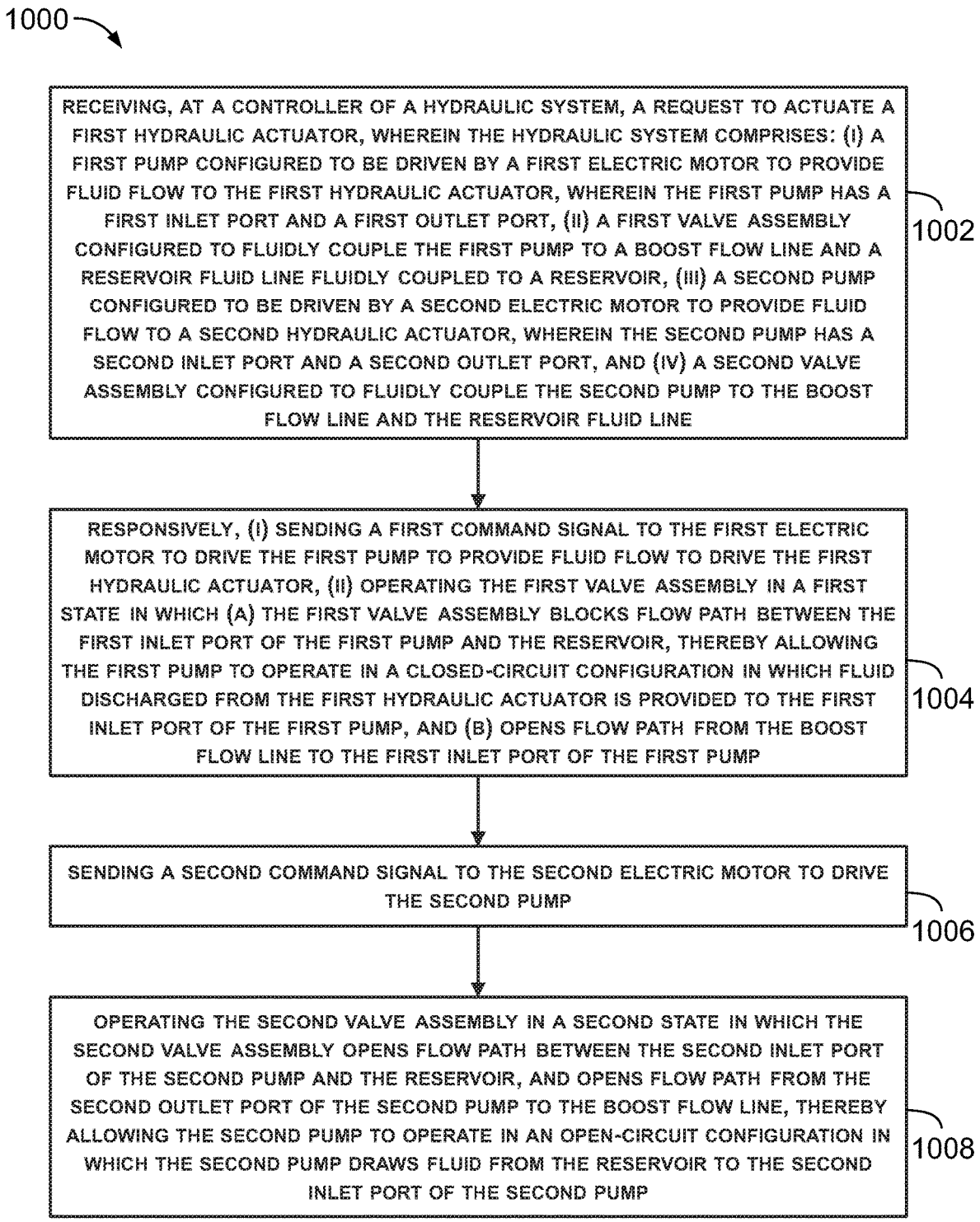
FIG. 10 is a flowchart of a method for operating a hydraulic system, in accordance with an example implementation.

FIG. 10 is a flowchart of a method 1000 for operating the hydraulic system 500, in accordance with an example implementation.

The method 1000 may include one or more operations, or actions as illustrated by one or more of blocks 1002-1008. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 1002, the method 1000 includes receiving, at a controller (e.g., the controller 248) of a hydraulic system (e.g., the hydraulic system 500), a request to actuate a first hydraulic actuator (the hydraulic cylinder actuator 502), wherein the hydraulic system comprises: (i) a first pump (e.g., the pump 516A) configured to be driven by a first electric motor (e.g., the electric motor 514A) to provide fluid flow to the first hydraulic actuator, wherein the first pump has a first inlet port (e.g., the pump port 522A) and a first outlet port (e.g., the pump port 518A), (ii) a first valve assembly (e.g., the valve assembly 564) configured to fluidly couple the first pump to the boost flow line 552 and the reservoir fluid line 530 fluidly coupled to the reservoir 532, (iii) a second pump (e.g., the pump 516B or the pump 516C) configured to be driven by a second electric motor (e.g., the electric motor 514B or the electric motor 514C) to provide fluid flow to a second hydraulic actuator (e.g., the hydraulic cylinder actuator 504 or the rotary hydraulic motor actuator 506), wherein the second pump has a second inlet port and a second outlet port, and (iv) a second valve assembly (e.g., the valve assembly comprising the mode switch valve 542B, the reservoir flow valve 546B, and the boost flow valve 544B or the valve assembly for comprising the mode switch valve 542C, the reservoir flow valve 546C, and the boost flow valve 544C) configured to fluidly couple the second pump to the boost flow line 552 and the reservoir fluid line 530.

At block 1004, the method 1000 includes responsively, (i) sending a first command signal to the first electric motor to drive the first pump to provide fluid flow to drive the first hydraulic actuator, (ii) operating the first valve assembly in a first state in which (a) the first valve assembly blocks flow path between the first inlet port of the first pump and the reservoir, thereby allowing the first pump to operate in a closed-circuit configuration in which fluid discharged from the first hydraulic actuator is provided to the first inlet port of the first pump, and (b) opens flow path from the boost flow line to the first inlet port of the first pump.

At block 1006, the method 1000 includes sending a second command signal to the second electric motor to drive the second pump.

At block 1008, the method 1000 includes operating the second valve assembly in a second state in which the second valve assembly opens flow path between the second inlet port of the second pump and the reservoir, and opens flow path from the second outlet port of the second pump to the boost flow line, thereby allowing the second pump to operate in an open-circuit configuration in which the second pump draws fluid from the reservoir to the second inlet port of the second pump.

The method 1000 can further include operating the first valve assembly and the second valve assemblies in other states that corresponding to other modes of operations described above with respect to FIG. 6-9 (e.g., flow summation and pressure summation modes of operation).

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" or "about" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A hydraulic system comprising:

a hydraulic actuator configured to receive and discharge fluid flow to move a piston or a hydraulic motor;

a pump configured to be a fluid flow source driven by an electric motor to provide fluid flow to the hydraulic actuator, wherein the pump has an inlet port and an outlet port;

a boost flow line configured to provide boost fluid flow or receive excess fluid flow;

a reservoir fluid line fluidly coupled to a reservoir; and a valve assembly configured to operate in a plurality of states comprising at least: (i) a first state in which the valve assembly blocks flow path between the inlet port of the pump and the reservoir fluid line, thereby allowing the pump to operate in a closed-circuit configuration in which fluid discharged from the hydraulic actuator is provided to the inlet port of the pump, and (ii) a second state in which the valve assembly opens flow path between the inlet port of the pump and the reservoir fluid line to allow the pump to draw fluid from the reservoir, and opens flow path from the outlet port of the pump to the boost flow line, thereby allowing the pump to operate in an open-circuit configuration in which fluid discharged from the hydraulic actuator is provided to the reservoir.

2. The hydraulic system of claim 1, wherein:

the hydraulic actuator is a hydraulic cylinder actuator comprising a cylinder and a piston slidably accommodated in the cylinder, wherein the piston comprises a piston head and a rod extending from the piston head, and wherein the piston head divides an internal space of the cylinder into a first chamber and a second chamber, and wherein the hydraulic cylinder actuator is unbalanced such that a first fluid flow rate provided by the pump to the first chamber or the second chamber to drive the piston in a given direction is different from a second fluid flow rate discharged from the other chamber as the piston moves, the boost flow line is configured to provide boost fluid flow or receive excess fluid flow comprising a difference between the first fluid flow rate and the second fluid flow rate, and the valve assembly is further configured to open flow path from the boost flow line to the inlet port of the pump while operating in the first state in which the pump operates in the closed-circuit configuration.

3. The hydraulic system of claim 1, wherein the valve assembly comprises:

a mode switch valve having a first port, a second port, a third port fluidly coupled to the outlet port of the pump, and a fourth port fluidly coupled to the inlet port of the pump;

a reservoir flow valve having a first port fluidly coupled to the reservoir fluid line and a second port fluidly coupled to the first port of the mode switch valve; and a boost flow valve having a first port fluidly coupled to the boost flow line and a second port fluidly coupled to the second port of the mode switch valve.

4. The hydraulic system of claim 3, wherein:

when the valve assembly is in the first state, the mode switch valve operates in a respective first state in which the mode switch valve fluidly couples the outlet port of the pump to the reservoir flow valve, and fluidly couples the inlet port of the pump to the boost flow valve, and when the valve assembly is in the second state, the mode switch valve operates in a respective second state in which the mode switch valve fluidly couples the outlet port of the pump to the boost flow valve, and fluidly couples the inlet port of the pump to the reservoir flow valve.

5. The hydraulic system of claim 4, wherein:

when the valve assembly is in the first state, the reservoir flow valve blocks fluid flow to the reservoir fluid line, whereas the boost flow valve allows fluid flow from the boost flow line to the second port of the mode switch valve, and when the valve assembly is in the second state, the reservoir flow valve allows fluid flow from the reservoir fluid line to the first port of the mode switch valve, whereas the boost flow valve allows fluid flow from the second port of the mode switch valve to the boost flow line.

6. The hydraulic system of claim 1, wherein the inlet port of the pump is fluidly coupled to a first port of the hydraulic actuator via a first fluid flow line, wherein the outlet port of the pump is fluidly coupled to a second port of the hydraulic actuator via a second fluid flow line, and wherein the hydraulic system further comprises:

a load-holding valve disposed in the first fluid flow line between the inlet port of the pump and the first port of the hydraulic actuator, wherein the load-holding valve is configured to operate in one state of at least two states: (i) a respective first state in which the load-holding valve allows fluid discharged through the first port of the hydraulic actuator to flow to the inlet port of the pump to allow the pump to operate in the closed-circuit configuration, and (ii) a respective second state in which the load-holding valve allows fluid discharged from the first port of the hydraulic actuator to flow to the reservoir fluid line to allow the pump to operate in the open-circuit configuration.

7. The hydraulic system of claim 6, wherein the load-holding valve is further configured to operate in a neutral state in which the load-holding valve blocks fluid discharged from the hydraulic actuator.

8. A machine comprising:

a boost flow line configured to provide boost fluid flow or receive excess fluid flow;

a reservoir fluid line fluidly coupled to a reservoir; and a plurality of hydraulic actuators, wherein each hydraulic actuator of the plurality of hydraulic actuators is configured to receive and discharge fluid flow to move a piston or a hydraulic motor, and wherein each hydraulic actuator comprises:

(i) a pump configured to be a fluid flow source driven by an electric motor to provide fluid flow to a respective hydraulic actuator to drive the respective hydraulic actuator, wherein the pump has an inlet port and an outlet port, and (ii) a valve assembly configured to operate in a plurality of states comprising at least: (a) a first state in which the valve assembly blocks flow path between the inlet port of the pump and the reservoir fluid line, thereby allowing the pump to operate in a closed-circuit configuration in which fluid discharged from the respective hydraulic actuator is provided to the inlet port of the pump, and (b) a second state in which the valve assembly opens flow path between the inlet port of the pump and the reservoir fluid line to allow the pump to draw fluid from the reservoir, and opens flow path from the outlet port of the pump to the boost flow line, thereby allowing the pump to operate in an open-circuit configuration in which fluid discharged from the respective hydraulic actuator is provided to the reservoir.

9. The machine of claim 8, wherein the machine is an excavator having a boom, an arm, a bucket, and a rotating platform, wherein the plurality of hydraulic actuators comprise: a boom hydraulic cylinder actuator, an arm hydraulic cylinder actuator, a bucket hydraulic cylinder actuator, and a rotary hydraulic motor actuator configured to rotate the rotating platform.

10. The machine of claim 8, wherein:

a first hydraulic actuator of the plurality of hydraulic actuators is a hydraulic cylinder actuator comprising a cylinder and a piston slidably accommodated in the cylinder, wherein the piston comprises a piston head and a rod extending from the piston head, and wherein the piston head divides an internal space of the cylinder into a first chamber and a second chamber, and wherein the hydraulic cylinder actuator is unbalanced such that a first fluid flow rate provided by a first pump of the first hydraulic actuator to the first chamber or the second chamber to drive the piston in a given direction is different from a second fluid flow rate discharged from the other chamber as the piston moves, the boost flow line is configured to provide boost fluid flow or receive excess fluid flow comprising a difference between the first fluid flow rate and the second fluid flow rate, a first valve assembly of the first hydraulic actuator operates in the first state, wherein when in the first state, the first valve assembly is further configured to open flow path from the boost flow line to the inlet port of the first pump, a second valve assembly of a second hydraulic actuator of the plurality of hydraulic actuators operates in the second state such that the second valve assembly opens flow path from the outlet port of a second pump of the second hydraulic actuator to the boost flow line, thereby providing the boost fluid flow comprising the difference between the first fluid flow rate and the second fluid flow rate for the first hydraulic actuator.

11. The machine of claim 8, wherein:

a first valve assembly of a first hydraulic actuator of the plurality of hydraulic actuators operates in the first state, wherein when in the first state, the first valve assembly is further configured to open flow path from the boost flow line to the inlet port of a first pump of the first hydraulic actuator, wherein the machine further comprises a load-holding valve configured to provide fluid discharged from the first hydraulic actuator to the reservoir fluid line, and a second valve assembly of a second hydraulic actuator of the plurality of hydraulic actuators operates in the second state such that the second valve assembly opens flow path from the outlet port of a second pump of the second hydraulic actuator to the boost flow line, thereby providing fluid flow from the outlet port of the second pump to the inlet port of the first pump.

12. The machine of claim 8, wherein:

a first valve assembly of a first hydraulic actuator of the plurality of hydraulic actuators operates in the second state, wherein when in the second state, the first valve assembly is further configured to open flow path from a first outlet port of a first pump of the first hydraulic actuator to the boost flow line, and a second valve assembly of a second hydraulic actuator of the plurality of hydraulic actuators operates in the second state, wherein when in the second state, the second valve assembly is further configured to open flow path from a second outlet port of a second pump of the second hydraulic actuator to the boost flow line, thereby causing the first pump and the second pump to be connected in parallel such that the first outlet port of the first pump is fluidly coupled to the second outlet port of the second pump via the boost flow line.

13. The machine of claim 8, wherein the valve assembly comprises:

a mode switch valve having a first port, a second port, a third port fluidly coupled to the outlet port of the pump, and a fourth port fluidly coupled to the inlet port of the pump;

a reservoir flow valve having a first port fluidly coupled to the reservoir fluid line and a second port fluidly coupled to the first port of the mode switch valve; and a boost flow valve having a first port fluidly coupled to the boost flow line and a second port fluidly coupled to the second port of the mode switch valve.

14. The machine of claim 13, wherein:

when the valve assembly is in the first state, the mode switch valve operates in a respective first state in which the mode switch valve fluidly couples the outlet port of the pump to the reservoir flow valve, and fluidly couples the inlet port of the pump to the boost flow valve, and when the valve assembly is in the second state, the mode switch valve operates in a respective second state in which the mode switch valve fluidly couples the outlet port of the pump to the boost flow valve, and fluidly couples the inlet port of the pump to the reservoir flow valve.

15. The machine of claim 14, wherein:

when the valve assembly is in the first state, the reservoir flow valve blocks fluid flow to the reservoir fluid line, whereas the boost flow valve allows fluid flow from the boost flow line to the second port of the mode switch valve, and when the valve assembly is in the second state, the reservoir flow valve allows fluid flow from the reservoir fluid line to the first port of the mode switch valve, whereas the boost flow valve allows fluid flow from the second port of the mode switch valve to the boost flow line.

16. The machine of claim 8, wherein the inlet port of the pump is fluidly coupled to a first port of the respective hydraulic actuator of the plurality of hydraulic actuators via a first fluid flow line, wherein the outlet port of the pump is fluidly coupled to a second port of the respective hydraulic actuator via a second fluid flow line, and wherein the machine further comprises:

a load-holding valve disposed in the first fluid flow line between the inlet port of the pump and the first port of the respective hydraulic actuator, wherein the load-holding valve is configured to operate in one state of at least two states: (i) a respective first state in which the load-holding valve allows fluid discharged through the first port of the respective hydraulic actuator to flow to the inlet port of the pump to allow the pump to operate in the closed-circuit configuration, and (ii) a respective second state in which the load-holding valve allows fluid discharged from the first port of the respective hydraulic actuator to flow to the reservoir fluid line to allow the pump to operate in the open-circuit configuration.

17. The machine of claim 16, wherein the load-holding valve is further configured to operate in a neutral state in which the load-holding valve blocks fluid discharged from the respective hydraulic actuator.

18. A method comprising:

receiving, at a controller of a hydraulic system, a request to actuate a first hydraulic actuator, wherein the hydraulic system comprises: (i) a first pump configured to be driven by a first electric motor to provide fluid flow to the first hydraulic actuator, wherein the first pump has a first inlet port and a first outlet port, (ii) a first valve assembly configured to fluidly couple the first pump to a boost flow line and a reservoir fluid line fluidly coupled to a reservoir, (iii) a second pump configured to be driven by a second electric motor to provide fluid flow to a second hydraulic actuator, wherein the second pump has a second inlet port and a second outlet port, and (iv) a second valve assembly configured to fluidly couple the second pump to the boost flow line and the reservoir fluid line;

responsively, (i) sending a first command signal to the first electric motor to drive the first pump to provide fluid flow to drive the first hydraulic actuator, (ii) operating the first valve assembly in a first state in which (a) the first valve assembly blocks flow path between the first inlet port of the first pump and the reservoir, thereby allowing the first pump to operate in a closed-circuit configuration in which fluid discharged from the first hydraulic actuator is provided to the first inlet port of the first pump, and (b) opens flow path from the boost flow line to the first inlet port of the first pump;

sending a second command signal to the second electric motor to drive the second pump; and operating the second valve assembly in a second state in which the second valve assembly opens flow path between the second inlet port of the second pump and the reservoir, and opens flow path from the second outlet port of the second pump to the boost flow line, thereby allowing the second pump to operate in an open-circuit configuration in which the second pump draws fluid from the reservoir to the second inlet port of the second pump.

19. The method of claim 18, wherein the hydraulic system further comprises a load-holding valve disposed between the first hydraulic actuator and the first inlet port of the first pump, the method further comprising:

actuating the load-holding valve to provide fluid discharged from the first hydraulic actuator to the reservoir fluid line, wherein the second valve assembly in the second state opens flow path from the second outlet port of the second pump to the boost flow line, thereby providing fluid flow from the second outlet port of the second pump to the first inlet port of the first pump.

20. The method of claim 18, further comprising:

switching the first valve assembly to operate in a respective second state, wherein when in the respective second state, the first valve assembly is configured to open flow path from the first outlet port of the first pump of the first hydraulic actuator to the boost flow line, wherein the second valve assembly in the second state opens flow path from the second outlet port of a second pump to the boost flow line, thereby causing the first pump and the second pump to be connected in parallel such that the first outlet port of the first pump is fluidly coupled to the second outlet port of the second pump via the boost flow line.

* * * * *